US007797767B2

(12) United States Patent
Benkhardt et al.

(10) Patent No.: US 7,797,767 B2
(45) Date of Patent: Sep. 21, 2010

(54) COVER FOR A WALL-HUNG URINAL AS WELL AS COVER OR SEAT BOARD FOR A TOILET

(76) Inventors: Axel Benkhardt, Willhöden 23, D-22487 Hamburg (DE); Andreas Hack, Albert-Schweizer-Strasse 17, D-22844 Norderstedt (DE)

( * ) Notice: Subject to any disclaimer, the term of this patent is extended or adjusted under 35 U.S.C. 154(b) by 0 days.

(21) Appl. No.: 11/724,514

(22) Filed: Mar. 15, 2007

(65) Prior Publication Data

US 2007/0169255 A1 Jul. 26, 2007

(51) Int. Cl.
*A47K 13/00* (2006.01)

(52) U.S. Cl. ..... 4/234; 4/661; 4/242.1

(58) Field of Classification Search ..... 4/234, 4/661, 242.1, 902, DIG. 18
See application file for complete search history.

(56) References Cited

U.S. PATENT DOCUMENTS

| | | | | |
|---|---|---|---|---|
| 2,111,044 | A * | 3/1938 | Crosby | 4/234 |
| 3,484,876 | A | 12/1969 | Thomas | |
| 5,182,823 | A * | 2/1993 | Alsip | 4/661 |
| 5,426,793 | A | 6/1995 | Mac | |
| 6,003,160 | A * | 12/1999 | Seidle et al. | 4/234 |
| 2006/0272079 | A1 * | 12/2006 | Moreda Alegria | 4/234 |

FOREIGN PATENT DOCUMENTS

| | | |
|---|---|---|
| DE | 29901068 | 2/2000 |
| DE | 20014159 | 12/2000 |
| DE | 20017149 | 12/2000 |
| FR | 2681232 | 3/1993 |

* cited by examiner

*Primary Examiner*—Khoa D Huynh
(74) *Attorney, Agent, or Firm*—Lucas & Mercanti, LLP; Klaus P. Stoffel

(57) ABSTRACT

A cover for a wall-hung urinal or a cover or a seat board (13) for the toilet seat (12) of a toilet (10) with interchangeable decoration and design elements or articles of daily use which are adapted to the respective individual wishes of the users has at least one through bore (210) or a blind bore (210'), whereby an insert member (200) filling the bore and held in the bore is placed fixedly or detachably in the bore (210; 210'), this insert member being configured as a full body or a hollow body, whereby the insert member (200) is made totally, partially or portionwise of a clear material with or without colouration, whereby fixed or movable decoration articles or articles of daily use or functional articles (230) such as lighting means, radio or television, a CD-player, a time displaying device, a speech and/or music module with a current production source such as a battery or a solar cell, liquid means or games, are placed in the material of the insert member (200) configured as a full body or in the inner space of the insert member (200) configured as a hollow body.

2 Claims, 23 Drawing Sheets

COVER FOR A WALL-HUNG URINAL AS WELL AS COVER OR SEAT BOARD FOR A TOILET

The invention relates to a toilet according to the preamble of claim 1.

Toilets according to the preamble of claim 1 are known. In spite of indicating labels fixed in public toilet rooms to close the toilet cover or the cover of a wall-hung urinal after having used the toilet, the covers of the toilets are often not closed after the end of the use of the toilet, what is also the case for not public toilets.

Thus, the aim of this invention is to provide a cover for a wall-hung urinal or a cover or a seat board for a toilet seat of a toilet with decoration and design elements adapted to the individual wishes of the respective users as well as with other appropriate articles of daily use, such as for example a timer, and configurations, profiles and the like which can be interchanged. Moreover, the users should be incited as a reward to close the toilet cover after having used a toilet or a wall-hung urinal.

This aim is achieved with a cover for a wall-hung urinal or with a cover or a seat board for a toilet according to the above described art with the characteristics indicated in claim 1.

Accordingly, the invention consists for a cover for a wall-hung urinal or for a toilet or a seat board or a toilet in that the cover and/or the seat board is provided with at least one through bore or blind bore, whereby an insert member filling the bore and held in the bore is placed in the bore, this insert member being configured as a full body or a hollow body, whereby the insert member is made totally, partially or portionwise of a clear, transparent, milky or translucent material, for example of a synthetic material, with or without colouration, whereby fixed or movable decoration articles or articles of daily use or functional articles such as lighting means, radio or television, a CD-player, a time displaying device, a speech and/or music module with a current production source, liquid means or games, are placed in the material of the insert member configured as a full body or in the inner space of the insert member configured as a hollow body.

The bore in the cover has the cross-sectional shape of a circle, of an ellipse, of a triangle, of a quad or a polygone or another geometrical shape, whereby the insert member has a conformation corresponding to the shape of the bore. The shape of the bore can also have, for example, a figurative, an one-dimensional or multidimensional configuration; the insert is then adapted to the shape of the bore. The cover itself can be made of all possible materials such as, for example, plastics, ceramics, glass, clear or coloured, of wood, metal, carbone, whereby the material of the insert member can be adapted to the material of the cover or can also be different.

In the cases in which sources of current are necessary, batteries or solar cells with current storing devices can be used.

Preferably, the surface of the insert member placed in the bore progressively turns into the surface of the cover or of the seat board.

For the detachable arrangement of the insert member in the bore, the insert member is held in the bore by means of a screw thread, a clamping joint, a bayonet catch or another appropriate locking device.

For the easy inserting of the insert member into the bore or for the easy removal of the insert member out of the bore, the insert member has for example recessed grips in its upper wall surface.

The wall of the insert member constituting the upper cover corresponds to the shape and to the cross-section of the bore.

The wall of the insert member constituting the upper cover can end at flush level with the circumferential edge of the cover or of the seat board.

The wall of the insert member which constitutes the upper cover can also project over the circumferential edge of the cover.

The number of the bores with their insert members in the cover or in the seat board can be any. In order to create an animated and attractive decoration, several insert members are placed in the cover, these insert members being placed in a geometrical correspondence, for example in rows or be subordinate.

According to a preferred embodiment, for forming the hollow space, the insert member consists of a cap-shaped bottom part and a cap-shaped cover part whereby, both parts being assembled, the vertical peripheral wall of the cover part laps over the vertical peripheral wall of the bottom part or the vertical peripheral wall of the bottom part laps over the vertical peripheral wall of the cover part, whereby the cover part and the bottom part are held together by clamping or press-fit or by other appropriate detachable connecting means.

The surface of the upper side wall of the insert member can have a plastic and figurative moulded body configuration or profile, for example in form of a Micky Maus figure. A speech and/or music module can be integrated into the moulded body configuration of the upper insert member wall. The surface of the upper side wall of the insert member can also have a plastic moulded body configuration, for example in form of a flower, a blossom or the like.

The blossom-type or flower-type moulded body configuration of the upper insert member wall can also contain aromatics.

According to another embodiment, the insert member is configured for example as a battery-operated clock, whereby differently configured sources of current can also be used.

The design or decoration elements placed in the hollow body or in the inner space of the insert member consist of:

a liquid coloured medium,
solid multidimensional objects,
photographical representations,
lamps with sources of current, whereby differently configured design or decoration elements can also be inserted.

The insert member can thus be equipped with a radio, a clock, with lighting means, for example in form of light-emitting diodes, whereby these articles of daily use or these functional objects can be embedded into the material of the insert member, whereby preferably actuating elements which can be operated from outside are then provided. The sources of current which are foreseen are also accessible from outside. If lighting means are provided, they can also be switched-on as dimmed light for the night in order to thus exert an indicating function. If the insert member is configured as a hollow space, a coloured liquid can preferably be provided in its inner space, namely also among others in connection with lighting means.

According to a further embodiment of the invention, a reward game in form of a Lotto betting system or of a horoscope predict is placed in the hollow space or in the inner space of the insert member.

Due to the use of insert members in a cover for a wall-hung urinal or in a cover or in a seat board of a toilet with design or decoration elements or with a reward game, it is possible to carry out an individual configuration of the cover or of the seat board. Due to the interchangeability of the individual insert members with the most different types of contents or occlusions in the material of the insert member or colorations, a new purchase of respective toilet parts is dropped since only already existing insert members are to be interchanged with differently configured insert members. In this way, a special additional colouration can be given to the toilet parts; moreover, the most different design or decoration elements can be interchanged over the insert members; since the insert member consists of two parts detachable from each other and connectable with each other, it is possible that also personally configured elements can be used. Electrical lighting effects, timers or the like make further individual configurations of the toilet cover and of the toilet seat possible. The insert member can be easily removed from its support in form of a bore in the cover or the seat board and inserted.

The reward game placed in the insert member is configured for example as a Lotto betting system.

The insert member configured as a reward game in form of a Lotto betting system comprises a bottom ascendingly guided into the rear area of the insert member with lateral delimitations and with at least one receiving shaft situated in the front area of the insert member for one or several rolling off, rollable, spherical and number bearing moulded bodies with numerical values fixed on their surfaces or impressions of individual or completing texts or symbols on the bottom, the cover or seat board being closed, and a window as a reading area in the area of the receiving shaft or of the receiving shafts in the upper insert member wall, whereby each spherical moulded body has on its spherical surface a number of same numerical values.

According to a further embodiment, the insert member comprises as a reward game one or a number of cubical or cylindrical or roller-shaped moulded bodies placed in the inner space of the insert member with markable faces on the moulded body surfaces, whereby the moulded body or the moulded bodies are provided with impressions of completing texts, symbols or the like. One or two or several chambers extending into the area of the window or parallel to each other are configured in the inner space of the insert member, each chamber receiving a number of cubical, cylindrical or roller-shaped moulded bodies, whereby each chamber runs into a receiving shaft situated in the area of the window for respectively one individual moulded body.

With the configuration of an insert member, there is provided a toilet with reward games for the toilet user which incites the toilet user to close the toilet cover after having used the toilet. These reward games consist in a Lotto game or a differently configured betting game and according to another embodiment in a horoscope game in which predicts for example about money, luck, love, health, job, partner and the like are given.

The toilet cover configured with such reward games or the cover of a wall-hung urinal is provided with a hint "Please close, your Lotto numbers are on the upper side of the cover" in its front area, namely especially in the vicinity of the window. When the toilet cover is opened, the spherical, cubical, cylindrical or roller-shaped moulded bodies gather in the rear area of the inner space of the toilet cover and, when the toilet cover swivels into the closing position, the moulded bodies in the insert member move into the front area of the toilet cover on the obliquely running unrolling surface and come into the receiving chambers configured in the front area of the insert member or of the toilet cover in its inner space. The cubical moulded bodies which bear the different numbers are then placed in the area of the window and can be read by the toilet user as a recommendation for the filling-in of a Lotto coupon. If an insert member is provided with a horoscope game, the toilet cover being in the closed position, respectively two cubical moulded bodies are then situated in the two receiving shafts, whereby then the texts or the indication of the one moulded body can be completed with that of the other moulded body. Predicts are then made, about money, luck, love, health, job, partnership or the like. Insert members configured in such a way can also be provided in the seat board of a toilet.

With such a configuration of such a toilet cover or of a cover of a wall-hung urinal, the toilet user is incited to close the toilet cover in order to take part in the corresponding game.

Advantageous configurations of the invention are the object of the subclaims.

Embodiments of the invention will be explained in more detail below with reference to the attached drawings.

Figure 1:
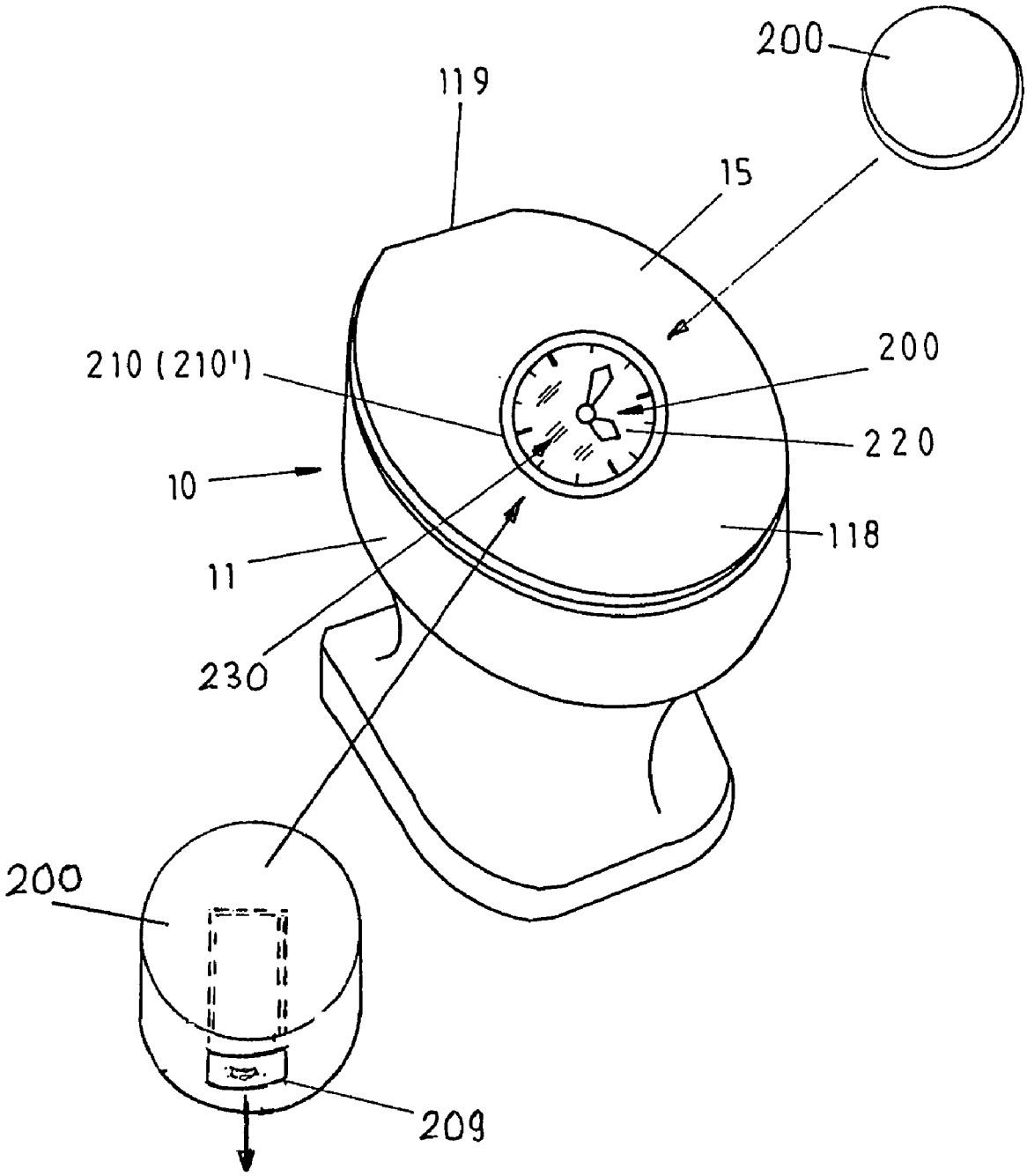
FIG. 1 shows a graphical view of a toilet with an insert member for receiving design or decoration objects or a reward game and with an insert member having a battery compartment, the toilet cover being closed.
Figure 2:
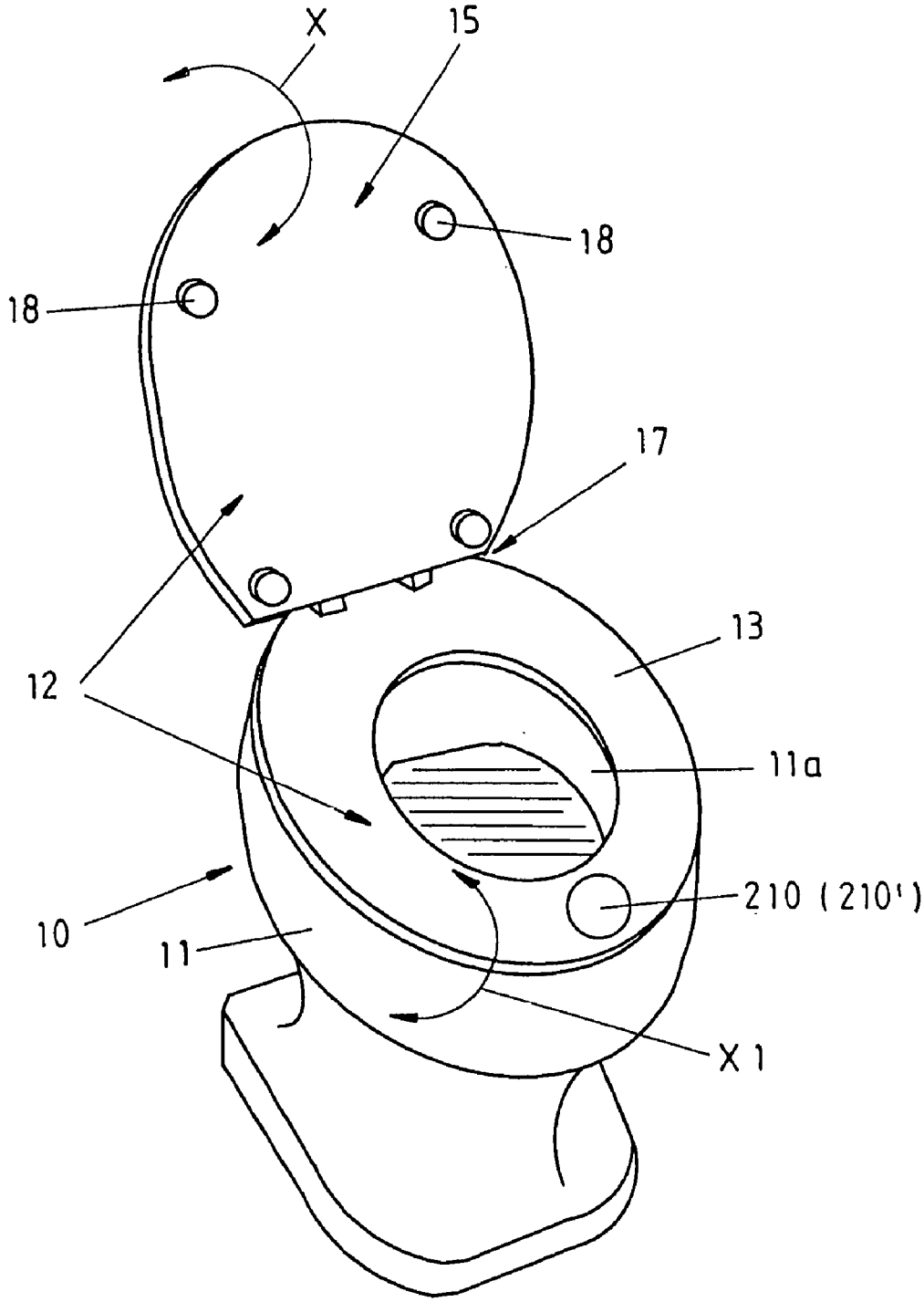
FIG. 2 shows a graphical view of a toilet according to FIG. 1, the toilet cover being opened.

FIG. 1 and 2 show a toilet 10 which comprises a toilet bowl 11 and a toilet seat 12 which is made of a seat board 13 and a toilet cover 15. The seat board 13 and the toilet cover 15 are swivellably connected with each other by a swivelling device placed in the hinge area 17 of the toilet seat 12 and with the toilet bowl 11.

The toilet cover 15 is swivellable in direction of the arrow X against the seat board 13. Regardless thereof, the seat board 13 can be swivelled in direction of the arrow X1 against the toilet bowl 11 and the toilet cover 15. In the first opening position shown in FIG. 2, the seat board 13 is supported on the peripheral edge of the toilet bowl 11 by intercalating knob-type spacers 18. The outer wall surface of the toilet cover 15 which is turned to the toilet bowl 11 is also provided with knob-type spacers over which the toilet cover 15 in the closing position is supported on the seat board 13. The inner space of the toilet bowl 11 is indicated by 11*a*.

The toilet cover 15, the seat board 13 and the toilet bowl 11 are made of wood, plastics, metallic materials, glass or other appropriate materials.

Figure 27:
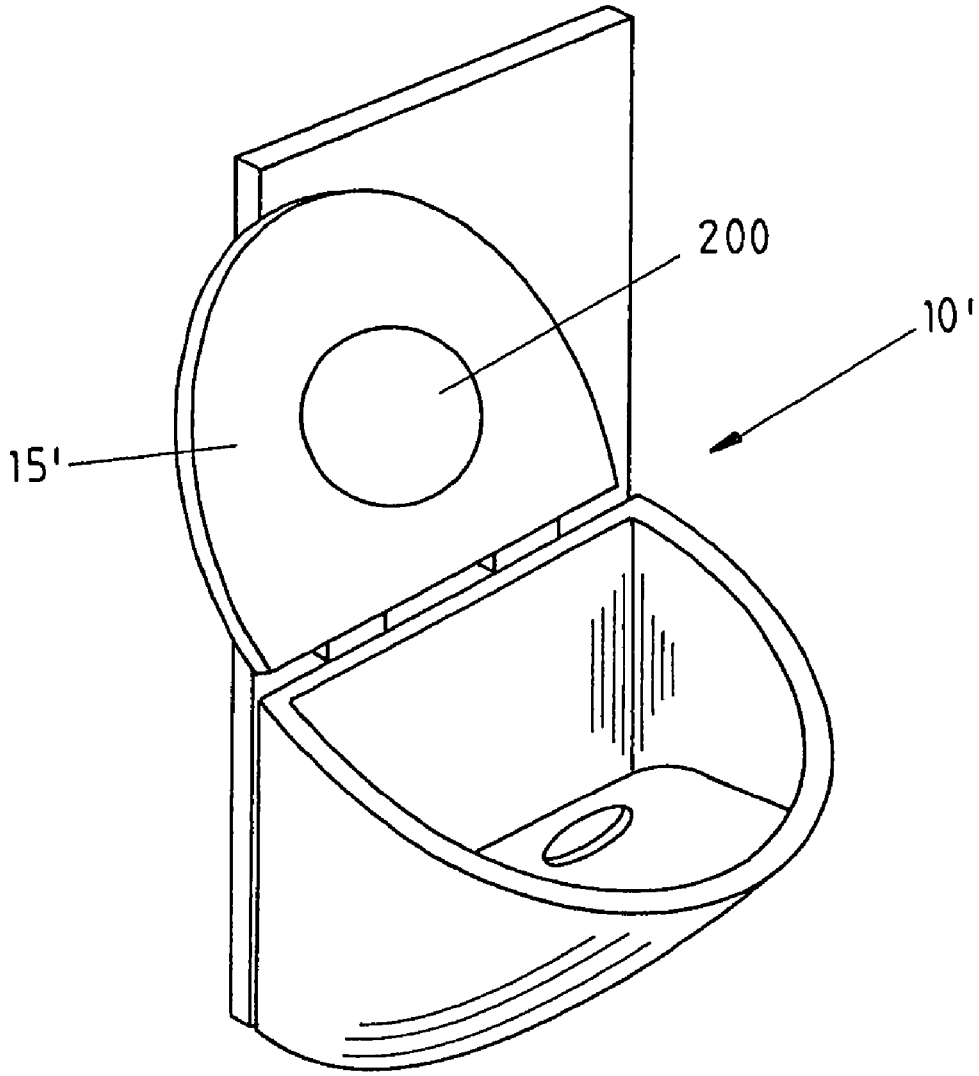
FIG. 27 shows a graphical view of a wall-hung urinal which can be closed by means of a cover.

FIG. 27 shows a wall-hung urinal 10' which can be closed by means of a cover 15'.

Figure 5:
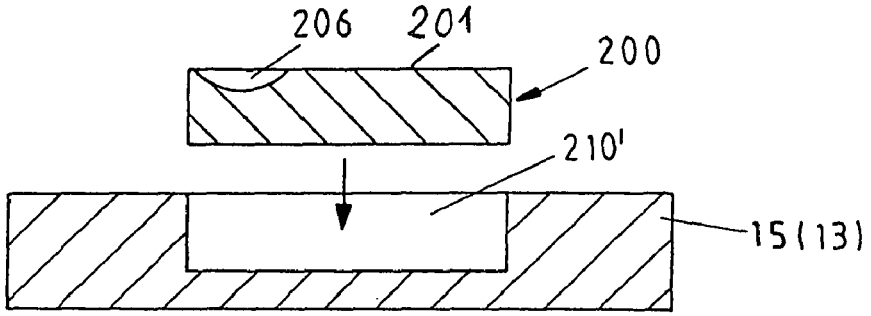
FIG. 5 shows a vertical section through the toilet cover with an insert member configured as a full body which can be placed into a blind bore in the toilet cover.
Figure 5A:
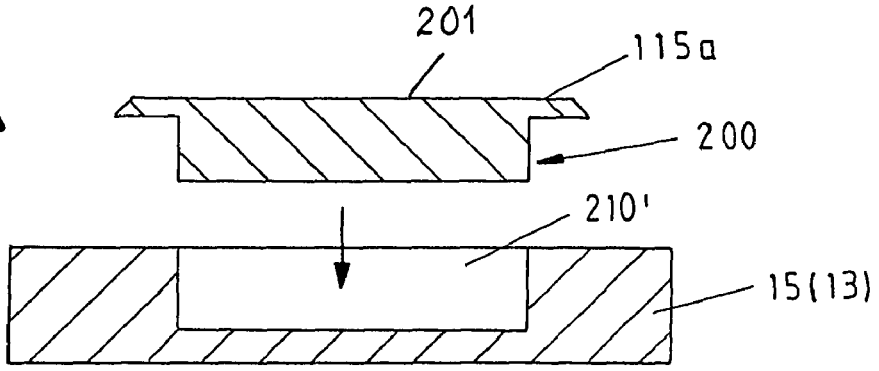
FIG. 5A shows a vertical section through the toilet cover with an insert member configured as a full body which can be placed into a blind bore in the toilet cover, whereby the insert member laps with its upper wall face over the peripheral edge of the bore.
Figure 5B:
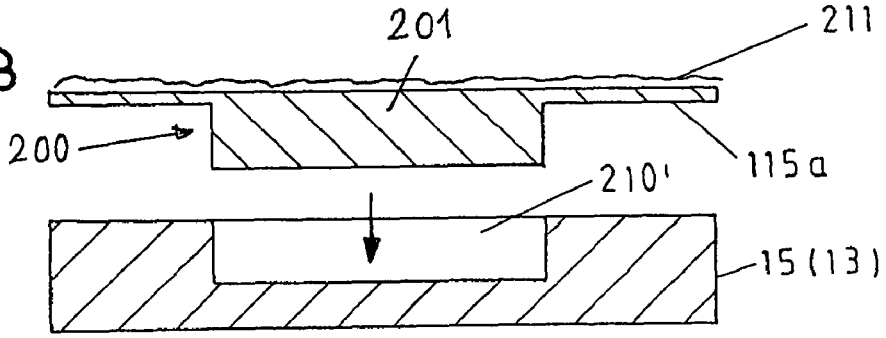
FIG. 5B shows a vertical section through the toilet cover with an insert member configured as a full body which can be placed into a blind bore in the toilet cover, whereby the insert member laps with its upper wall face over the toilet cover upper surface and is provided with a surface decoration.

The cover 15' of the wall-hung urinal 10' and the cover 15' or the seat board 13 of the toilet 10 are provided with at least one bore 210 or blind bore 210' for receiving an insert member 200 which can be placed into the bore 201, 210' (FIG. 1, 2 and 27). The number of the bores 210, 210' in the cover 15, 15' or in the seat board 13 can be chose any. This insert member 200 can be configured as a full body 201 (FIG. 5, 5A, 5B, 5C, 5E and 5F) or as a hollow body 205 with an inner space 207 (FIG. 5D). The bore 210, 210' can be circular, triangular, square or polygonal and have any geometrical shape. The insert member 200 is configured fitting and has a cross section shape corresponding to the cross section shape of the bore 210, 210'. The thickness of the insert member 200 corresponds to the depth of the bore 210, 210' so that, when placed in the bore 210, 210', the insert member 200 with its upper side wall 115 turns flush into the upper wall surface of the cover 15, 15' or of the seat board 13, thus progressively. The upper side wall 15 of the insert member 200 can be provided with a recessed grip 206 or with a differently configured handle for placing into and removing out of the bore 210, 210' (FIG. 5). As FIG. 5A shows, the upper side wall 115 of the insert member 200 is provided with a peripheral edge 115*a* which laps over the surface of the cover 15,15' or of the seat board 13. The peripheral edge 115*a* can also extend over the whole surface of the cover 15, 15' or the bearing surface of the seat board 13 (FIG. 5B), whereby the upper side wall 115 of the insert member 200 can also be guided as far as over the upper peripheral edge of the cover 15, 15' or of the seat board 13. As FIG. 1 among others shows, the insert member 200 is provided with a telescoping battery compartment 209 for receiving a battery as source of current for appliances placed in the insert member 200 which are operated by electrical current. Furthermore, the insert member 200 is provided with a base surface and/or a suspension arrangement in order to use the insert member 200 also outside the toilet cover, for example as a wall clock or as a grandfather's clock.

Figure 5C:
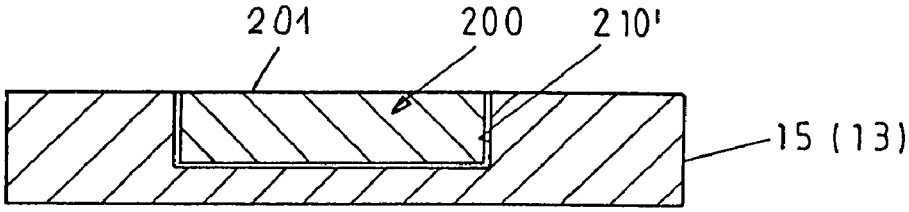
FIG. 5C shows a vertical section through the toilet cover with an insert member configured as a full body placed in the blind bore in the toilet cover.
Figure 5D:
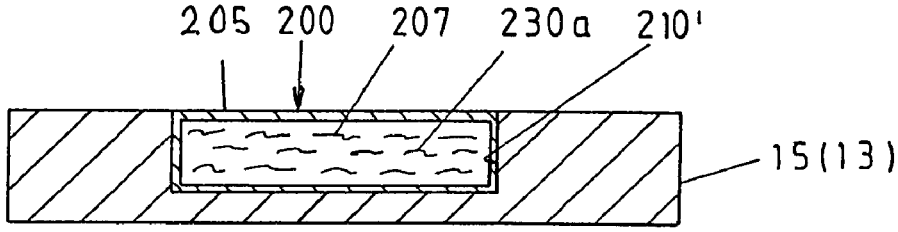
FIG. 5D shows a vertical section through the toilet cover with an insert member configured as a hollow body placed in the blind bore in the toilet cover.

If the bore in the cover 15, 15' is configured as a blind bore 210', the conformation of the insert member 200 corresponds to that of the blind bore (FIG. 5C). If the insert member 200 is configured as a hollow body 205, its arrangement in the bore 210' takes places in accordance with the arrangement of a massive insert member (FIG. 5D).

Figure 5E:
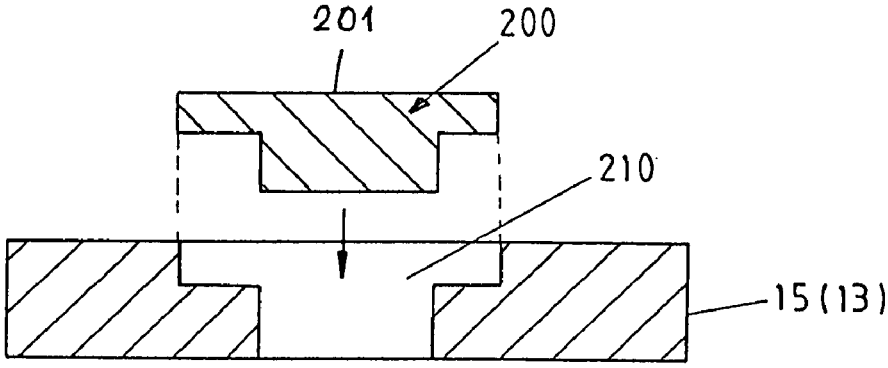
FIG. 5E shows a vertical section through the toilet cover with an insert member which can be placed in a through bore in the toilet cover, whereby the through bore has a neck-shaped tapered portion and the insert member corresponds to the conformation of the through bore.

According to FIG. 5E, the through bore 210 can be provided with a neck-type taper; the insert member 200 is then configured correspondingly. For a through bore 210 according to FIG. 5F, the insert member 200 has a thickness which corresponds to the depth of the through bore so that the upper side wall 115 and the lower side wall 116 of the insert member 200 turn to the respective surfaces of the cover 15,15' or of the seat board 13.

The insert member 200 is held in the bore 210, 210' by clamping or press-fit. Screwed connections or snap-in connections as well as bayonet-type catches can also be used for a detachable connection. Besides detachable connections, the insert member 200 can also be placed fixedly in the bore 210, 210'. The insert member 200 is made totally, partially or portionwise of a clear, transparent, milky or translucent synthetic material with or without colouration, whereby it is insignificant if the insert member 200 is configured as a full body or as a hollow body. In special cases, the insert member 200 can also be made of a not transparent or not translucent synthetic material or other materials, whereby windows are then formed in the insert member.

Figure 5F:
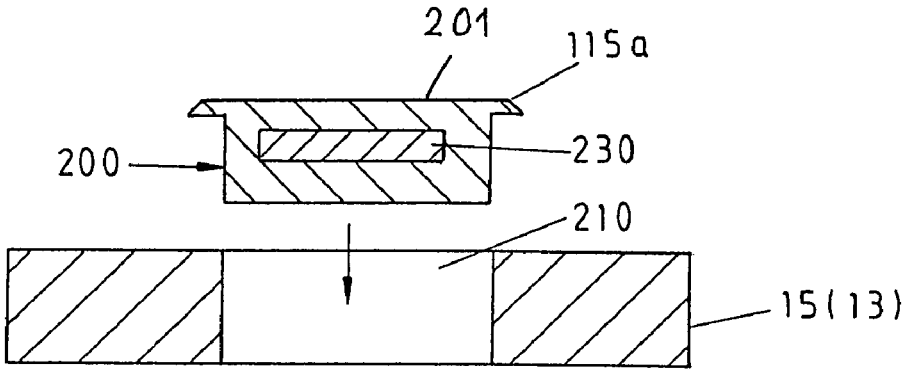
FIG. 5F shows a vertical section through the toilet cover with an insert member which can be placed in a through bore in the toilet cover, whereby the insert member configured as a full body has a height which corresponds to the depth of the through bore and an upper wall face which laps over the peripheral edge of the through bore.

According to an embodiment of the invention, design or decoration objects, lamps, radios, CD-players, time indicating devices, a speech and/or music module or other objects 230 are embedded into the material of the insert member 200 configured as a full body 201, as well as sources of current, as far as the inserted objects must be supplied with current (FIG. 5F).

Figure 5G:
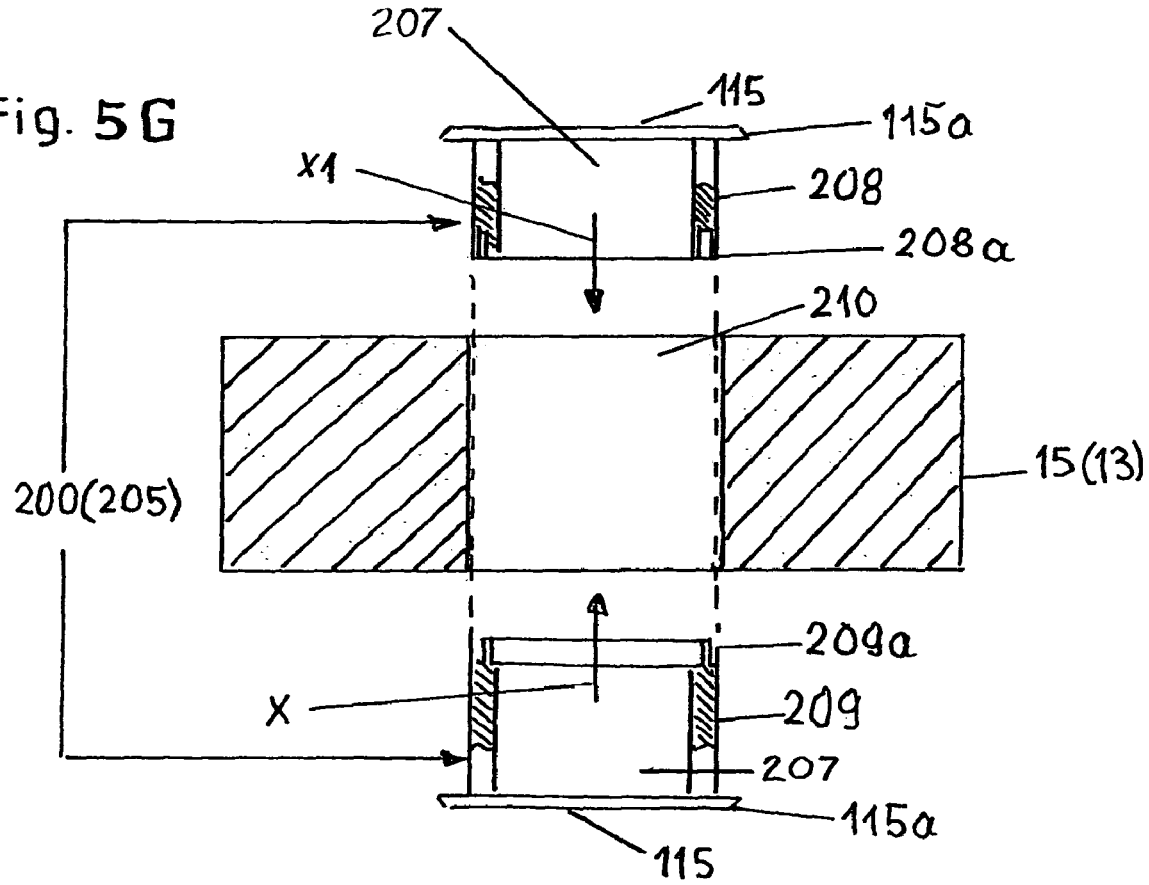
FIG. 5G shows a vertical section through the toilet cover with an insert member configured as a hollow body which can be placed in a through bore in the toilet cover, the insert member being made of two cap-shaped parts which can be connected with each other.

According to FIG. 5G, a through bore 210 is provided in the cover 15. The insert member 200 which can be placed into the through bore is configured for example as a hollow body 205 and is made of two cap-shaped parts, namely a cap-shaped cover part 208 and a cap-shaped bottom part 209. Both parts are preferably configured alike. The surfaces 115 of both parts 208, 209 have laterally projecting peripheral edge portions 115*a*. The height of both parts 208, 209 corresponds to the depth of the through bore 210 in the cover 15 so that, when both parts 208, 209 are pushed in direction of the arrow X, X1 into the two openings of the through bore 210, the free peripheral edges of the two parts 208, 209 come to rest the one on each other, whereby simultaneously the projecting edges 115*a* rest firmly on the surface and on the lower face of the cover 15 and have a sealing effect, whereby additional gaskets can still be mounted on the lower sides of the projecting edge portions 115*a*. Both parts 208, 209 are connected with each other by edge connections, plug-type connections, screw-type connections, bayonet catch connections, whereby for example the connecting elements are formed on the opposed edges 208*a*, 209*a* of the two parts 208, 209.

In the insert member 200 is configured as a hollow body 205, the design or decoration objects 230 are then placed in the inner space 207 of the insert member 200. Fixed or movable objects or design or decoration elements, liquid media 230*a* can be placed in the inner space 207 of the insert member 200 (FIG. 5D). Furthermore, the invention provides the arrangement of games, for example reward games 20 or 120, for example in form of a Lotto betting system or in form of a horoscope predict game in the inner space 207 of the insert member 200.

For constituting the hollow space in the insert member 200, the insert member is made of a cap-shaped bottom part 209 and a cap-shaped cover part whereby, when both parts 208 and 209 are assembled, the vertical peripheral wall 208*a* of the cover part 208 laps over the vertical peripheral wall 209*a* of the bottom part 209 (FIG. 14 and 20) or the vertical peripheral wall 209*a* of the bottom part 209 laps over the vertical peripheral wall 208*a* of the cover part 208, whereby the cover part 208 and the bottom part 209 are held together by clamping or press-fit.

The surface of the upper side wall 115 of the insert member 200 has a plastic and figurative moulded body configuration 211, for example in form of a Micky Maus figure, of a flower, a blossom or the like (FIG. 5B). The moulded body configuration 211 can be one-dimensional or multidimensional. For a blossom-type or flower-type moulded body configuration, aromatics can be contained. A speech and/or music module 320 can be integrated into the moulded body configuration 211.

Figure 11:
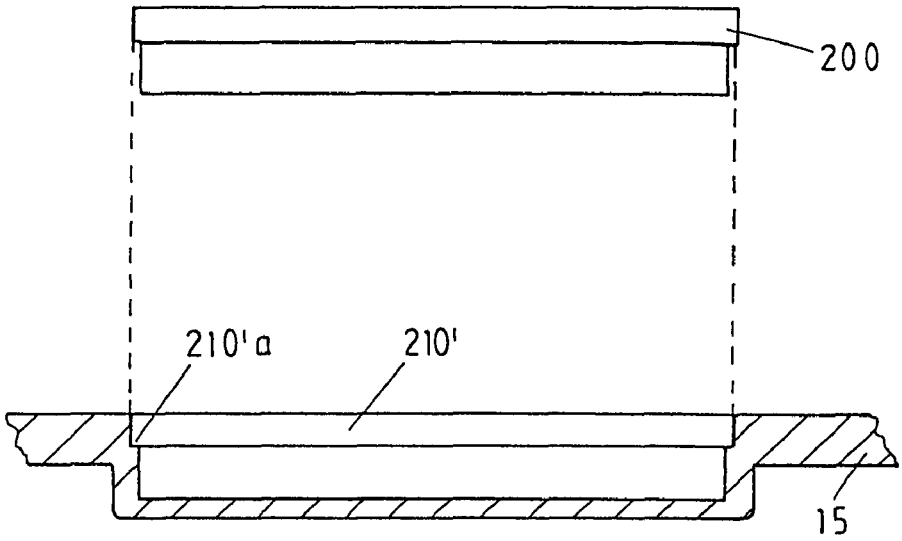
FIG. 11 shows in a vertical section a section of the toilet cover with a blind bore configured therein in the art of a recess which is shouldered to the bottom to the surface plane of the toilet cover, whereby the depth of the bore is bigger than the thickness of the toilet cover.
Figure 11A:
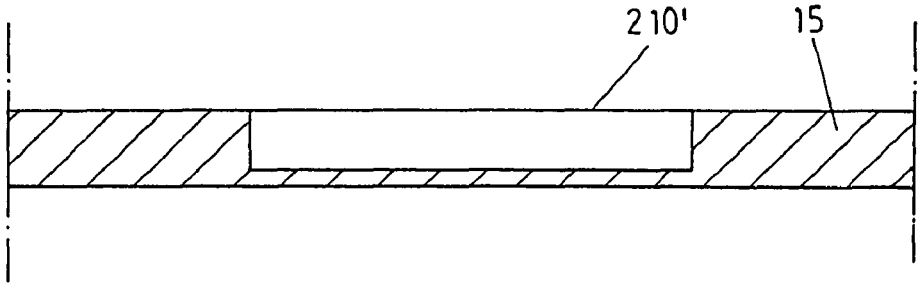
FIG. 11A shows in a vertical section a portion of the toilet cover with a blind bore configured therein in the art of a recess with a wall portion delimiting the bore to the bottom which has a lower thickness.
Figure 11B:
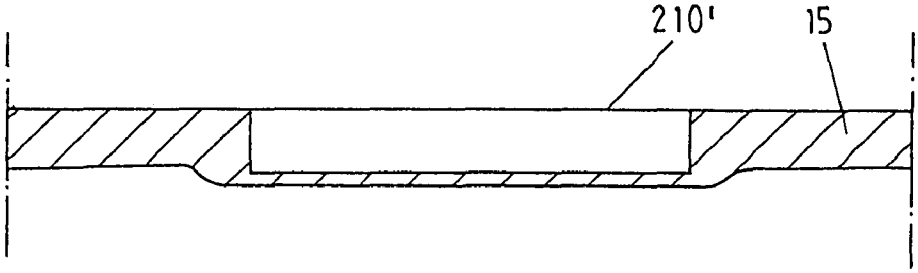
FIG. 11B shows the toilet cover according to FIG. 11A, however with a wall portion delimiting the bore which is shouldered to the bottom to the surface plane of the toilet cover, whereby the depth of the bore corresponds to the thickness of the toilet cover.
Figure 11C:
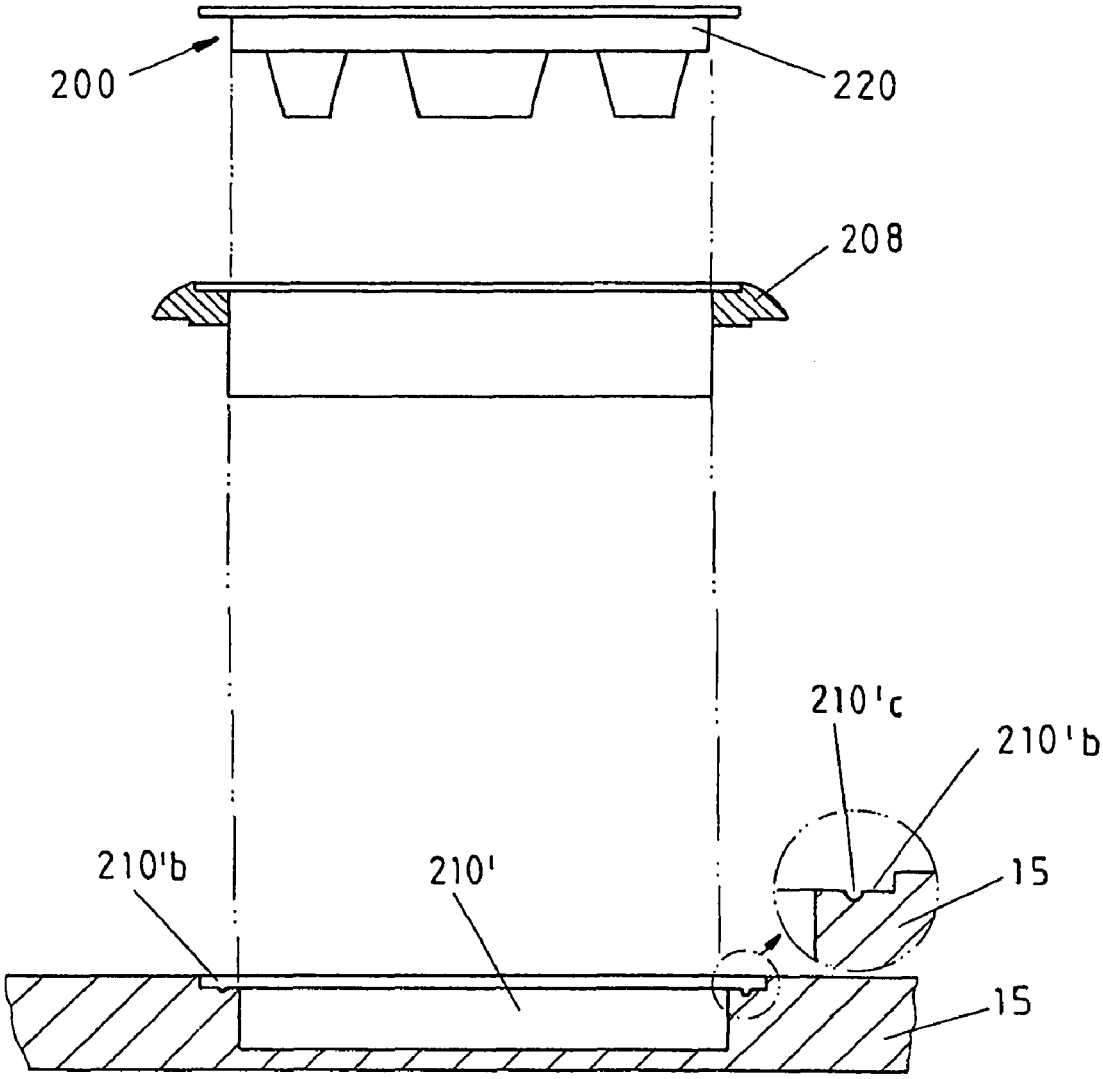
FIG. 11C shows in vertical section representations a portion of the toilet cover with a blind bore, a clock which can be placed into the blind bore and a sealing cover which can be placed onto the opening of the blind bore and the clock.

According to a further embodiment, the insert member 200 can be provided with a for example battery-operated clock 220 (FIG. 1 and 11C).

Figure 6:
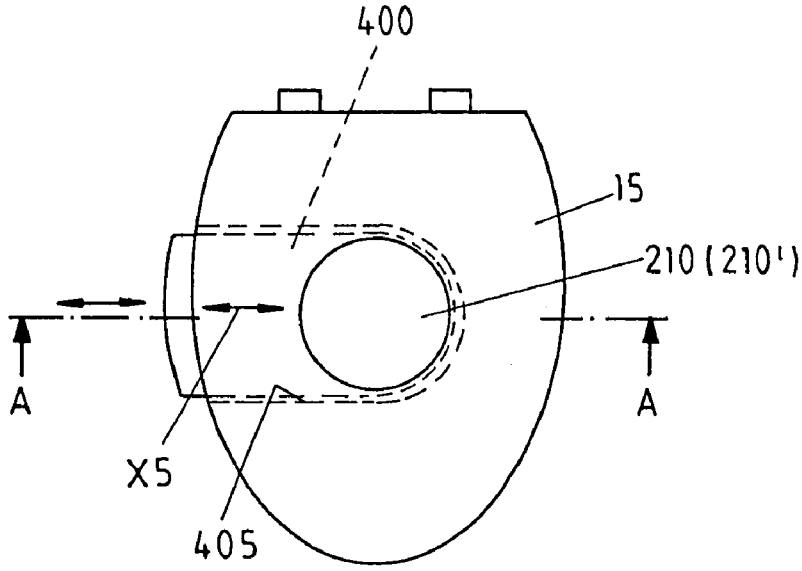
FIG. 6 shows a topview of a toilet cover with a window and with a slit-shaped configured recess in the toilet cover for receiving a slide, the portion of which is situated in the area of the window being configured in the art of an insert member.
Figure 6A:
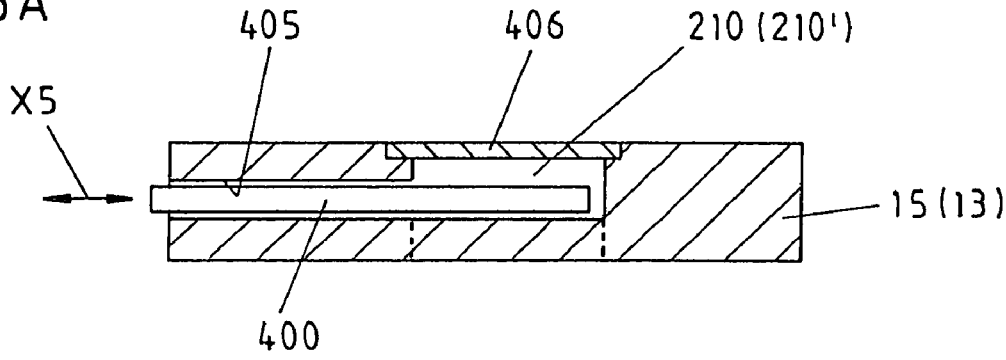
FIG. 6A shows a vertical section according to line A-A in FIG. 6.
Figure 6B:
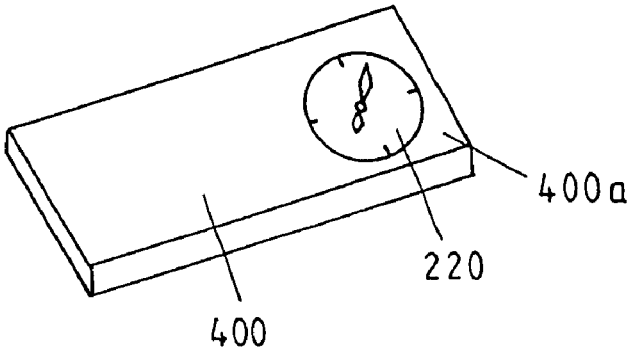
FIG. 6B shows a graphical view of the slide which a clock placed in its end area.

The decoration objects, articles of use or functional objects which are placed in the insert member 200 can also be placed in a slide 400 according to FIG. 6 and 6A. For this embodiment, the toilet cover 15 is provided with a through bore 210 or a blind bore 210' and with a slit-type recess 405 for receiving the slide extractable and retractable in direction of the arrow X5, this slide carrying at its end 300*a* opposite the bore 210 the decoration objects, the articles of use or the functional objects such as, for example, a clock 220 or a radio or lighting means which are supplied with current over a solar cell or a battery and which are provided with a circuit closer and breaker which is operationally connected with the toilet cover 15 in such a way that, when the cover 15 swivels, the switching on and off of the functional objects takes place. The arrangement of the decoration objects, of the articles of use and functional objects on the slide 400 is such that, when the slide is pushed-in, the objects come to rest in the area of the through bore 210 or blind bore 210' and thus take a position able to be seen. A window-type cover 406 of a clear material can be provided in the upper area of the through bore or of the blind bore.

If the toilet cover 15 or 13 is provided with a through bore 210, the insert member can be pushed into the through bore from below.

Figure 7:
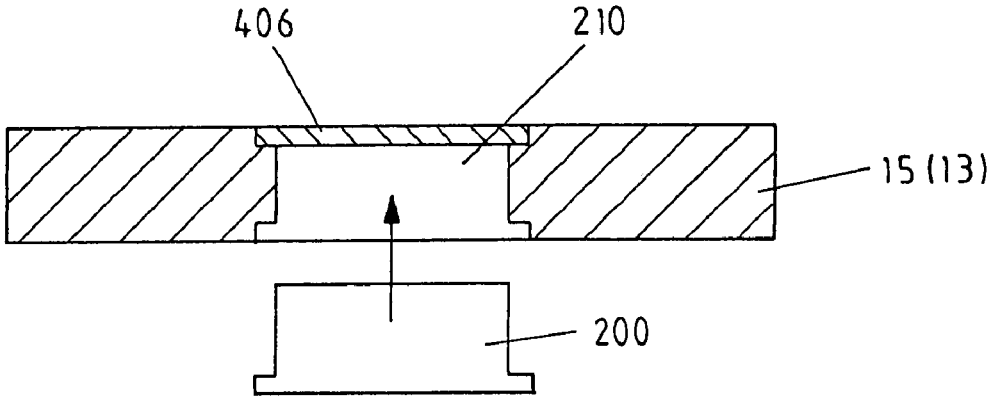
FIG. 7 shows partly as a view, partly in a vertical section a toilet cover with a through bore for receiving an insert member to be pushed-in from below and with an upper cover of the through bore.

In the upper area, the through bore 210 is covered by means of a window-type cover 406 made of a clear material (FIG. 7). In this embodiment and for all the other embodiments, the insert member is placed in the through bore in such a manner that all the faces of the insert member rest in the surface planes of the toilet cover 15.

Figure 8:
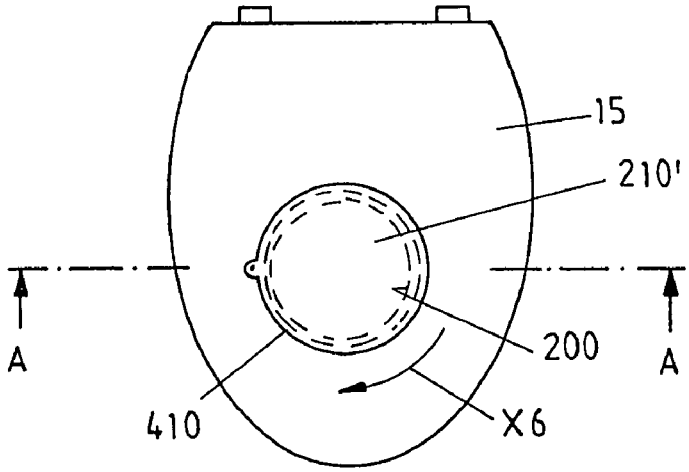
FIG. 8 shows a topview of the toilet cover with a blind bore receiving an insert member, whereby this blind bore can be covered on the upper side by means of a swivellable covering plate.
Figure 8A:
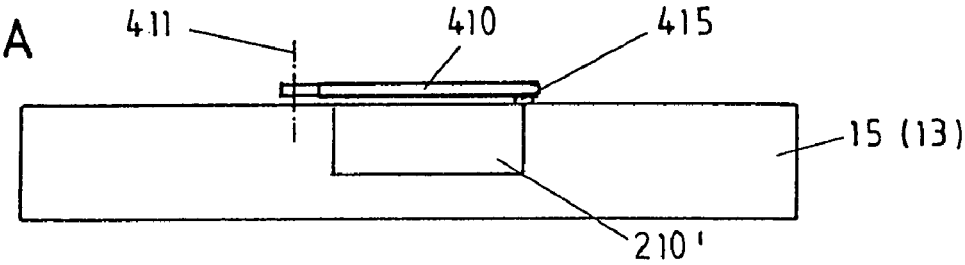
FIG. 8A shows a vertical section according to line A-A in FIG. 8.

For the embodiment according to FIG. 8 and 8A, the through bore or the blind bore 210' which receives the insert member 200 is closed in the upper area by a cover plate 410 which is swivellable about a vertical swivelling axis 411 in direction of the arrow X6 in order to be able to close or uncover the upper opening of the blind bore in order, in the last case, to close or to give a view over the insert member 200. The securing of the cover plate 410 on the surface of the toilet cover 15 is made by means of a magnetic lock 415 or by appropriate differently configured devices.

Figure 8B:
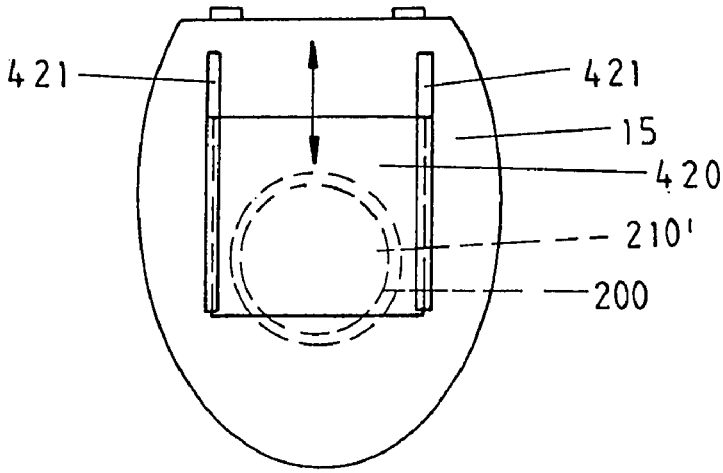
FIG. 8B shows a topview of a further embodiment for a seal of the upper opening of a through bore or of a blind bore in the toilet cover.

The closing of the upper opening of the blind bore in the toilet cover 15 can be made according to FIG. 8B by a sliding plate 420 which is held and guided in lateral guides 421 and which is locked for example by means of a magnetic lock on the surface of the toilet cover 15.

Figure 9:
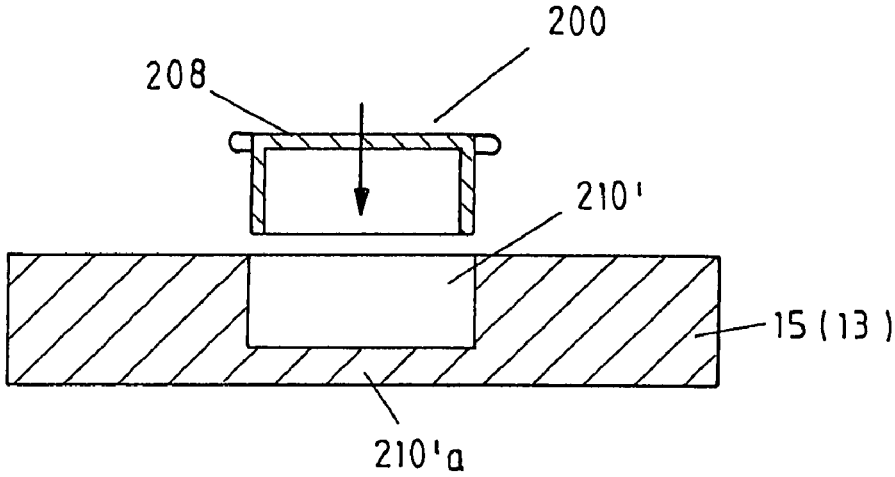
FIG. 9 shows in a vertical section a toilet cover with a blind bore with a cap-shaped configured insert member.
Figure 9A:
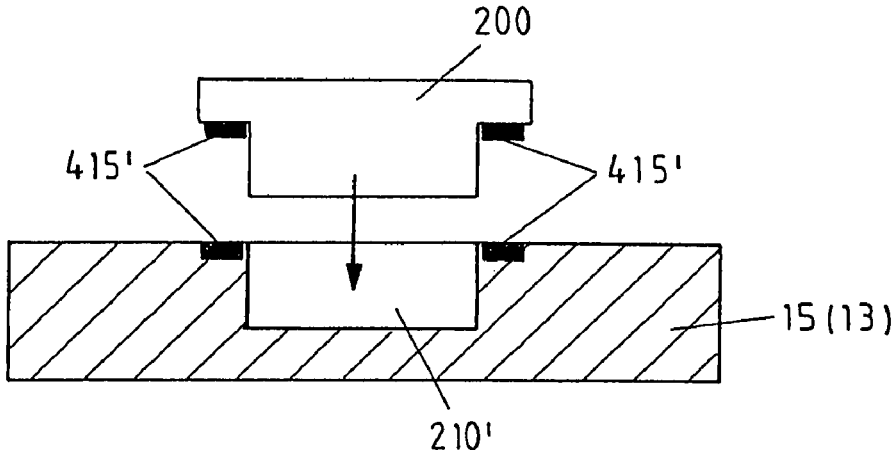
FIG. 9A shows partly as a view, partly in a vertical section the toilet cover according to FIG. 9 with a magnetic connection for supporting the insert member in the blind bore in the toilet cover.

The insert member 200 can also be configured as a cap-shaped cover part 208; depending on the configuration of the bores 210, 210', it can be inserted from below, from above and also from both sides, whereby in the last case two cap-shaped insert members are placed which have a height, when placed, which corresponds to the length of the bore. In the inner space, the cap-shaped insert member receives then the decoration objects, the articles of use or the functional objects. In case of blind bores 210', the remaining wall portion 210'*a* of the bore 210' then forms the seal for the insert member (FIG. 9). The support and fixing of the insert member 200 with its peripheral projecting edge can be made for example on the surface of the toilet cover 15 by means of a magnetic lock 415' (FIG. 9A).

Figure 10:
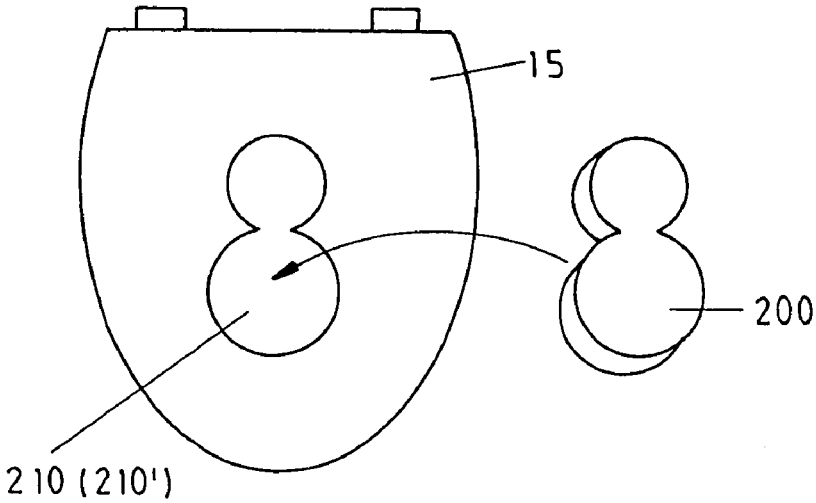
FIG. 10 shows a toilet cover in a topview with a figuratively configured bore in the toilet cover and with a correspondingly configured insert member which can be fittingly placed into the bore.

The bore 210, 210' in the toilet cover 15 has, according to FIG. 10, a figuratively configured conformation which can be configured any. The conformation of the insert member 200 corresponds to the figuratively configured conformation or cross section form of the bore.

According to FIG. 11, the toilet cover 15 has a recess-type blind bore 210' which is shouldered to the bottom to the lower surface plane of the toilet cover 15 so that the depth of the blind bore 210' is bigger than the thickness of the toilet cover wall so that relatively high insert members 200 with a big inner space can be inserted. The wall delimiting the bore 210' is provided with a ring-shaped step 210'*a* on which the insert member 200 rests when it is inserted, the insert member having a corresponding profile of the outer wall surface. This ring-shaped steps serving as a rest can be provided with a peripheral gasket.

FIG. 11A shows a toilet cover 15 with a recess-type blind bore 210'. The wall portion which closes the bore 210' at the bottom is thin-walled. A blind bore 210' with a depth which approximately corresponds to the thickness of the toilet cover wall is obtained according to FIG. 11B when the wall portion of the toilet cover which delimites the bore 210' at the bottom comes to rest below the surface plane formed by the lower wall surface of the toilet cover 15.

According to FIG. 11C, the toilet cover 15 is provided with a blind bore 210', the upper peripheral edge of which enlarges by forming a peripheral recess 210'*b*. The so formed supporting surface serves for the support of an insert ring 208 which can be placed onto the bore 210' by means of its peripheral edge. The supporting surface is provided with a peripheral groove 210'*c* which receives a packing ring which is not represented in the drawing. The insert member 200, which is configured as a clock 220, is then placed in the insert ring 209. The insert member 200 is also provided with a laterally projecting peripheral edge which rests in a peripheral recess in the surface of the insert ring 208 when the insert member 200 is placed in the insert ring 208 which is preferably made of a flexible synthetic material. The insert member 200 with the clock 220 and the insert ring 208 form, when assembled, an unit which is held over the insert ring 208 in the blind bore 210' of the toilet cover 15.

The design or decoration elements 230 placed in the inner space 207 of the insert element 200 consist for example of:

a liquid coloured medium
solid multidimensional objects,
photographical representations or
lamps with sources of current.

According to a further embodiment, a reward game 20 in form of a Lotto betting system or of a horoscope predict is placed in the inner space 207 of the insert member 200.

Figure 12:
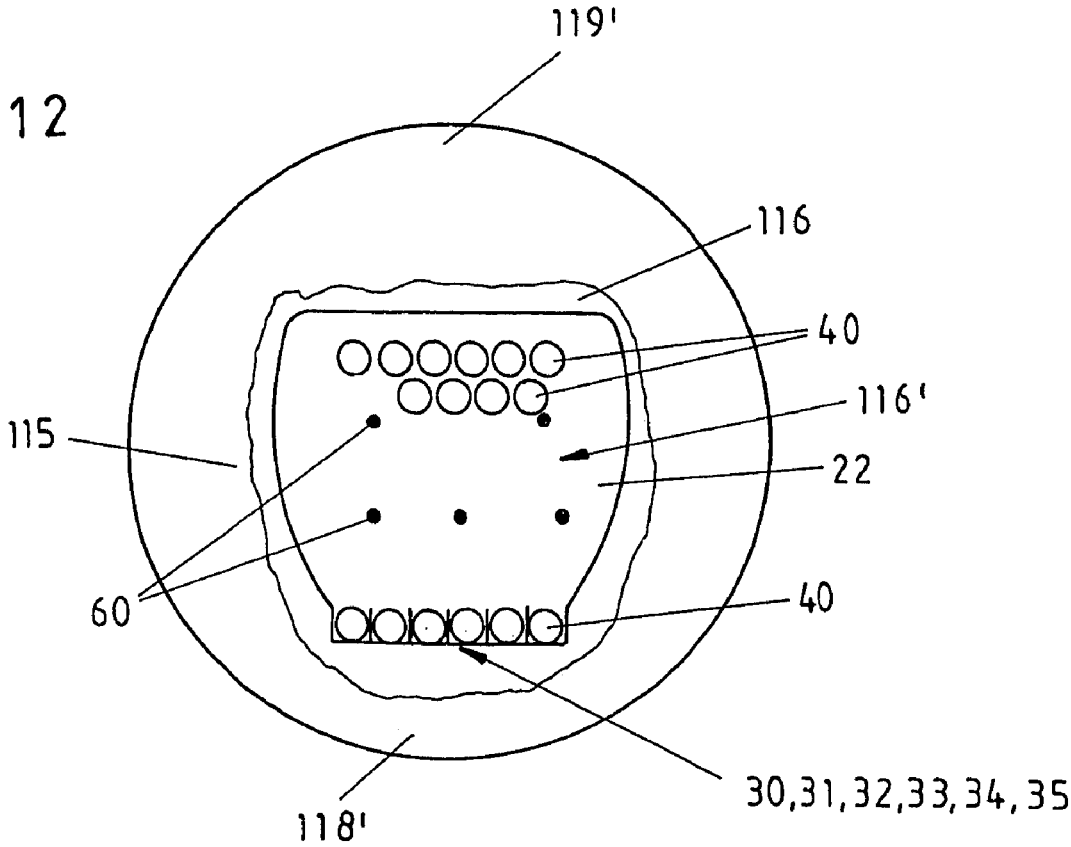
FIG. 12 shows a view from below of an insert member with an uncovered reward game of a first embodiment with cam-shaped pins placed distributed on the spherical rolling-off surface.
Figure 16:
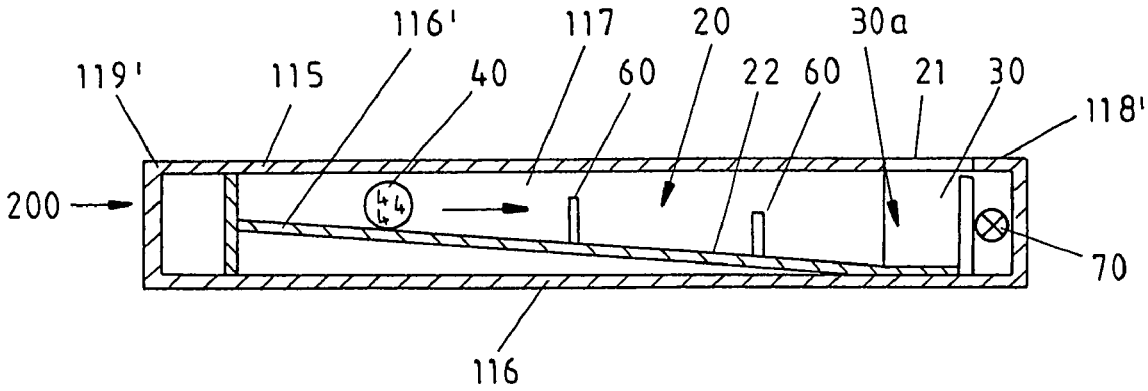
FIG. 16 shows partly as a view, partly as a vertical section, the insert member with a reward game placed and/or configured therein.

The insert member 200 according to FIG. 16 is provided with a first reward game 20 described in more detail below. To this purpose, the insert member 200 is configured by constituting an inner space 207 receiving the reward game 20 with double walls with an upper cover wall 115 and a lower cover wall 116. A number of spherical and number bearing moulded bodies 40 is placed in the so formed inner space 207 of the insert member 200. In the front area which is turned to the front area 118 of the insert member 200, a window 21 which extends over the width or over a part of the width of the insert member 200 is constituted in the insert member 200, this window being situated in the upper cover wall 115. The bottom 116' which delimits the inner space 207 of the insert member 200 is guided ascendingly from the front area 118 of the insert member 200 to the rear area 119 of the insert member 200 by configuring an obliquely running surface 22 (FIG. 16). The insert member 200 is made of opaque plastics or of other appropriate materials, whereby the window 21 is then configured in the upper insert member side wall 115. The insert member 200 can also be totally made of a clear synthetic material. It is also possible that only the upper insert member side wall 115 is made of a clear synthetic material so that the separate configuration of a window is dropped. Furthermore, in an embodiment of the upper insert member side wall 115 of a clear synthetic material, the window can be configured in that on the outer and on the inner side of the side wall 115 a colour coating is applied for example by spraying by forming a free surface as window 21. In the front area of the insert member 200 turned to the front area 118 of the toilet cover 15 and thus in the area of its window 21, at least one receiving shaft is configured or, as represented, a number of receiving shafts 30, 31, 32, 33, 34, 35 with run-in openings 30*a*, 31*a*, 32*a*, 33*a*, 34*a*, 35*a* guided in direction of the rear area 119 of the toilet cover 15 for the spherical moulded bodies 40 which carry numbers 50 on their spherical surfaces 40*a* (FIG. 12,13,14,15,16).

Each spherical moulded body 40 has on its spherical surface 40*a* a number of same numerical values. The receiving shafts 30, 31, 32, 33, 34, 35 are dimensioned in such a manner that each receiving shaft 30 and/or 31 and/or 32 and/or 33 and/or 34 and/or 35 receives a single spherical moulded body 40 or several spherical moulded bodies 40 placed in a row the one behind the other so that, when the toilet cover 15 is in a closed horizontal state, the spherical moulded bodies 40 run-in into the receiving shafts 30, 31, 32, 33, 34, 35 of the insert member 200 come to rest in the area of the window 21. Several spherical moulded bodies can also roll into one receiving shaft; however, the respective front spherical moulded body with the numbers is always recognizable in the window 21. The receiving shaft(s) 30, 31, 32, 33, 34, 35 have a length which corresponds to a multiple of the diameter of a spherical or cylindrical moulded body 40, 140'*a*. So, the length of each receiving shaft 30, 31, 32, 33, 34, 35 can correspond to the diameter of two, three, four, five or several spherical or cylindrical moulded bodies 40, 140'*a*.

The spherical moulded bodies 40 can also have another geometrical configuration, whereby only such shapes which make possible a rolling-off on the obliquely running surface 22 of-the bottom 116' of the insert member 200 can be used. So, the moulded bodies 40 can be configured cubically as hexaeders, as rhombic dodecahedrons, as pentagonal dodecahedrons, as icosahedrons (twenty surfaces), as icositetrahedrons (twenty four surfaces), as octahedrons. Instead of a rolling-off surface 22 configured separately in the inner space 207 of the insert member 200, the lower insert member side wall 116 can be configured obliquely running.

The respectively predetermined spherical or cubical faces carry then the numbers 50.

Figure 15:
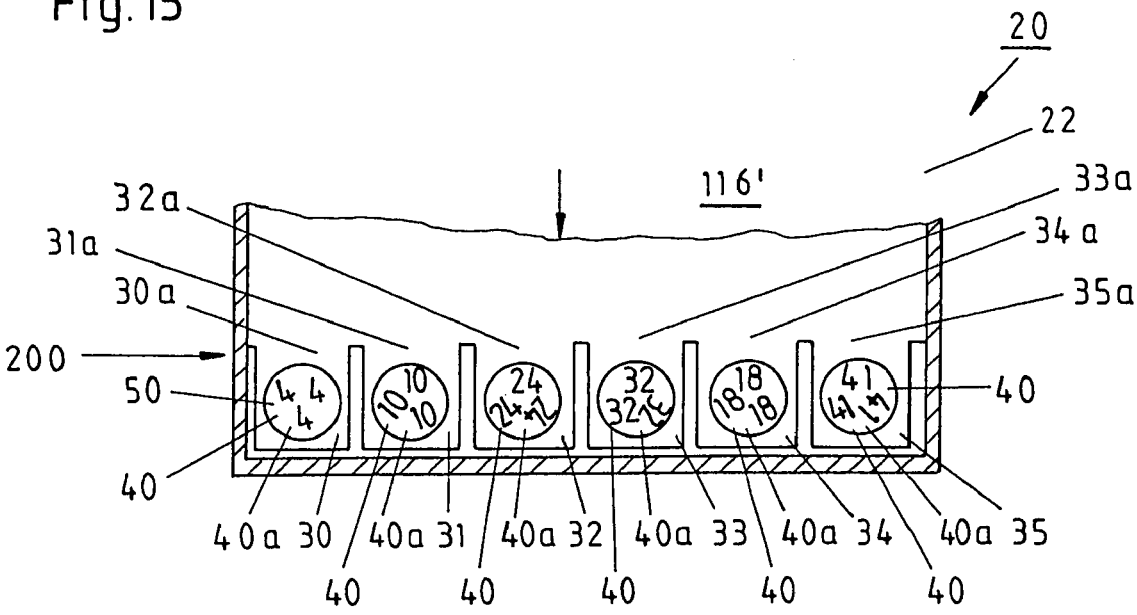
FIG. 15 shows an enlarged view of the receiving chambers for the spherical moulded bodies of the reward game.

According to a preferred embodiment, a multitude of spherical moulded bodies 40 which corresponds to the Lotto betting system is placed in the inner space 207 of the insert member 200, namely forty nine spherical moulded bodies 40. these moulded bodies 40 carry on their spherical surfaces 40*a* the numbers from one to forty nine, whereby each spherical moulded body 40 has several times the number assigned to it so that in each position of the moulded body 40 in one of the receiving shafts 30, 31, 32, 33, 34, 35 the corresponding number of the moulded body is respectively visible and placed so as to be visible in the area of the window 21 (FIG. 15). In the case of this configuration of the reward game 20 as a Lotto betting system game, six receiving shafts 30, 31, 32, 33, 34, 35 are provided in the inner space 207 of the insert member 200 for the spherical moulded bodies 40.

Figure 13:
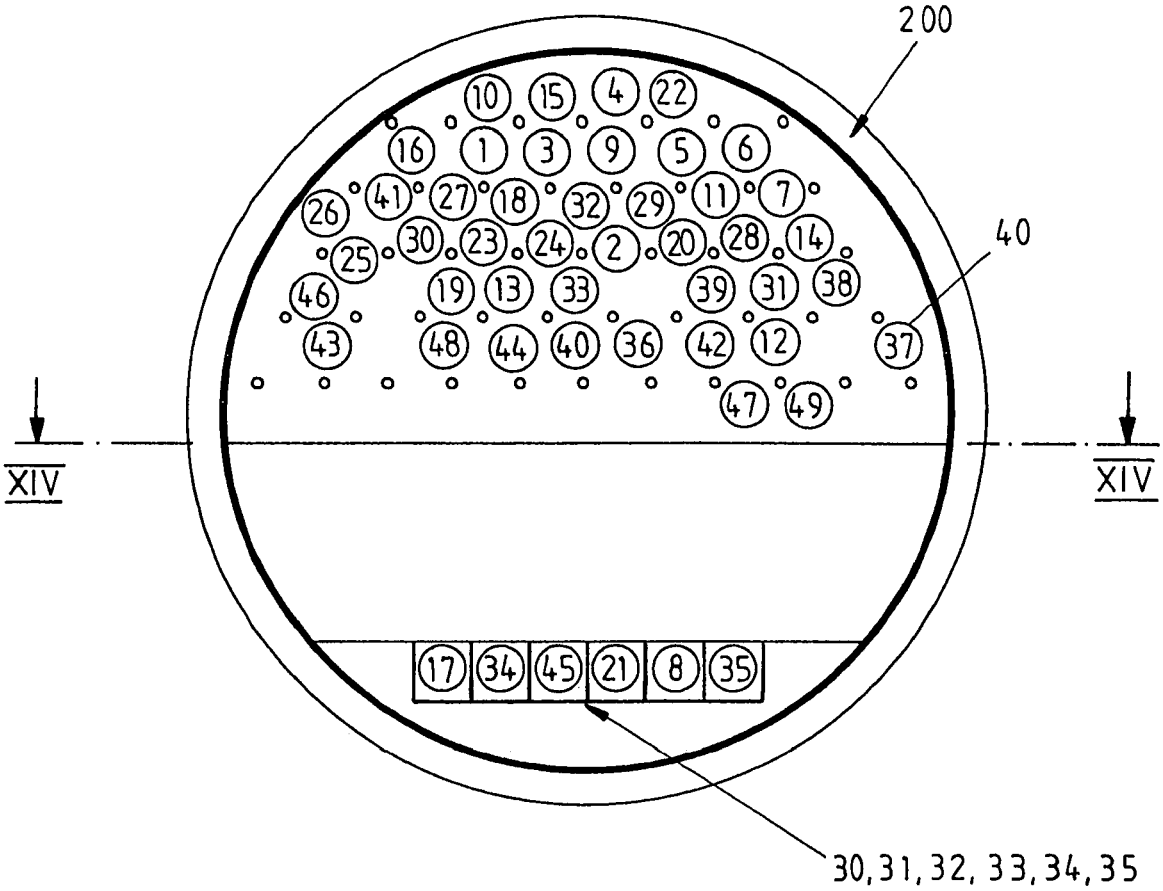
FIG. 13 shows a topview of an insert member with a further embodiment of a reward game according to FIG. 12 placed therein.
Figure 14:
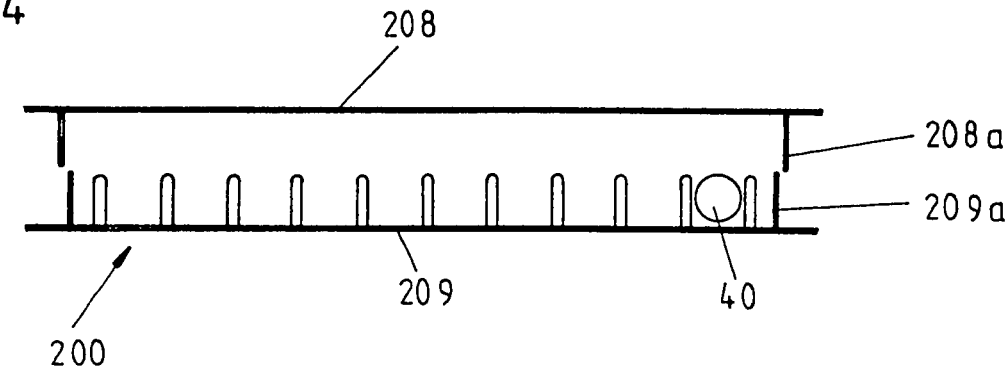
FIG. 14 shows a vertical section according to line XIV-XIV of FIG. 13.

For increasing the shuffling effect for the moulded bodies 40, the bottom 116' which delimits the inner space 207 of the insert member 200 has on its rolling-off surface or its obliquely running surface 22 for the moulded bodies 40 a number of vertical pins or cams 60 placed distributed on the rolling-off surface of the bottom 116' in an area situated before the receiving shafts 30, 31, 32, 33, 34, 35 for the moulded bodies 40, whereby these pins or cams 60 have a minimal distance from each other which is dimensioned in such a manner that the moulded bodies 40 can move freely through the interstices between the pins or cams 60, namely in direction of the receiving shafts 30, 31, 32, 33, 34, 35, when the toilet cover 15 takes a horizontal closing position (FIG. 12,13 and 14).

The pins or cams 6 on the rolling-off surface of the bottom 116' are placed in several rows situated the one under the other, whereby the pins or cams 60 of the individual rows are offset the one to the other (FIG. 12 and 16).

The inner space 207 of the insert member 200 has preferably a height which corresponds to at least the diameter of the spherical moulded bodies 40, whereby the receiving shafts 30, 31, 32, 33, 34, 35 have dimensions which correspond to those of a moulded body 40.

Figure 17:
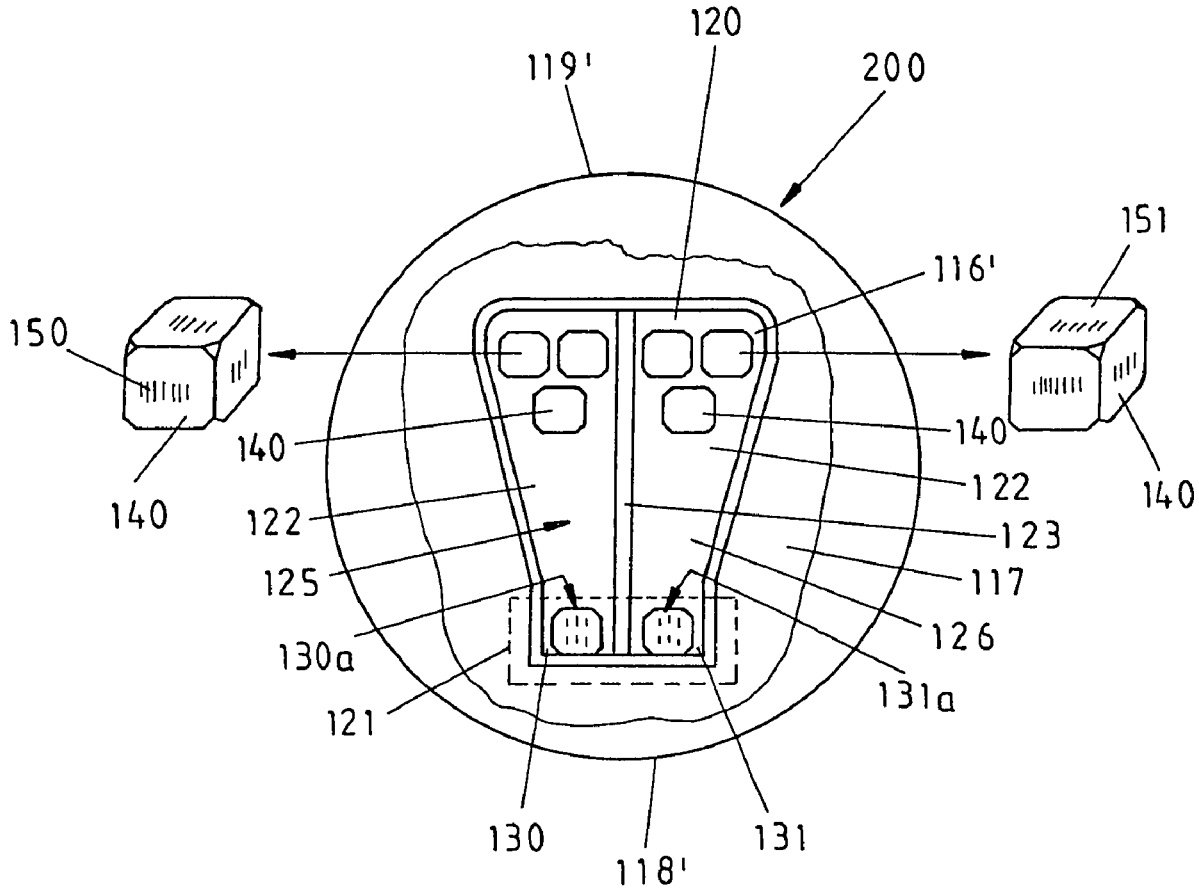
FIG. 17 shows partly as a view, partly as a horizontal section the insert member with an uncovered reward game in a second embodiment.

The second embodiment of an insert member 200 shown in FIG. 17 with a reward game 120 in form of a horoscope game also starts from a configuration of the insert member 200 which has the above described embodiment. Here, the toilet 10 also consists of a toilet bowl 11 with a toilet seat 12 which is formed by a seat board and the toilet cover 15. The parts of the toilet seat 12 such as seat board and toilet cover 15 are swivellable against each other and to the toilet bowl 11.

At least one insert member 200 which is also configured with double walls is placed in the toilet cover 15 or in the seat board 13, whereby the constituted inner space 207 is limited by the upper cover wall 115 and the lower cover wall 116. The front and rear area of the insert member 200 is indicated by 118' and 119'.

The configuration of the toilet cover 15 for the reward game 120 is as follows:

A window 121 which extends over the width of the insert member 200 is configured in the front area 118' of the insert member 200. The bottom 116' which delimits the inner space 207 of the insert member 200 to the lower cover wall 116 is guided ascendingly from the front area 118' of the insert member 200 to the rear area 119' of the insert member 200 by constituting an obliquely running surface 122 as rolling-off surface parallel and in a straight line for a number of cubical and cylindrical moulded bodies 140,141, 140'*a* placed in the inner space 207 of the insert member 200 with markable faces on the moulded body surfaces 140*a*, 141*a*, whereby the lower insert member side wall 116 can also be configured running obliquely. Two chambers 125,126 extending up to the area of the window 121, which are separated from each other by a vertical partition wall 123, are constituted in the inner space 207 of the insert member 200. Each chamber 125 or 126 receives at least one spherical, cubical or cylindrical moulded body 140,141 and runs into a receiving shaft 130, 131 situated in the area of the window 121 for respectively one single moulded body 140 or 141. The moulded bodies 140 of the one chamber 125 and the moulded bodies 141 of the other chamber 126 are provided with imprints of completing texts, symbols or the like, i.e. characters 150, 151 are on the moulded bodies 140, 141.

Instead of cubical moulded bodies 140, 141, moulded bodies with other geometrical conformations can also be used, such as for example those which are configured as cubes or octahedrons. However, configurations, for example in form of hexagonal prisms or protoprisms with protopyramides can also be used. It is essential that the surfaces of the moulded bodies which are put in can be written on and that the moulded bodies roll-off on the obliquely running surface 22 in the individual chambers 125, 126 and can roll into the receiving shafts 130, 131 without jamming thereby. One chamber is also possible.

The window 21 or 121 is configured in the upper side wall 116 of the insert member 200 in the area of the receiving shafts 30, 31, 32, 33, 34, 35 or 130, 131 for the moulded bodies 40 or 141. It is also possible to configure the upper side wall 116 of the insert member 200 in the area of the whole inner space 207 of the insert member 200 as window 21, 121. Moreover, it is also possible to make the whole insert member 200 of a clear synthetic material. The window 21, 121 is preferably made of a clear synthetic material.

Figure 3:
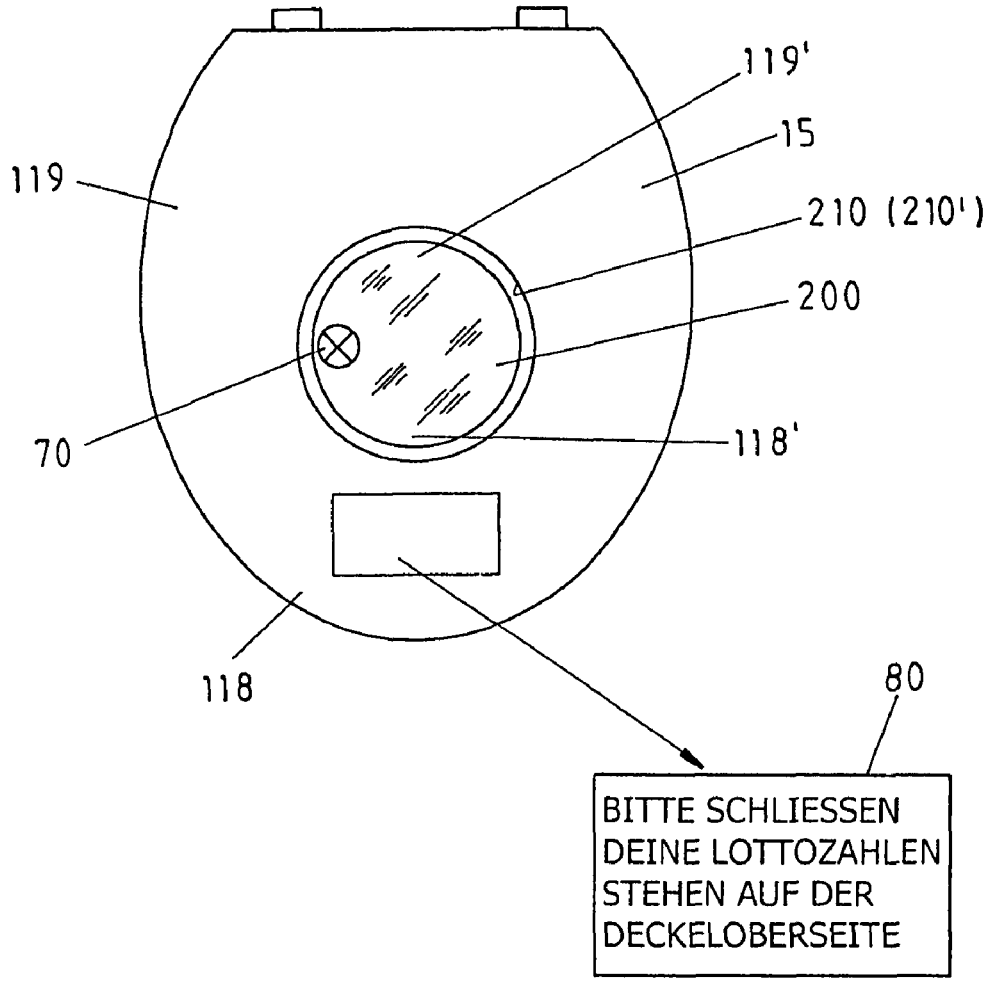
FIG. 3 shows a top view of the toilet cover of the toilet with the insert member.
Figure 4:
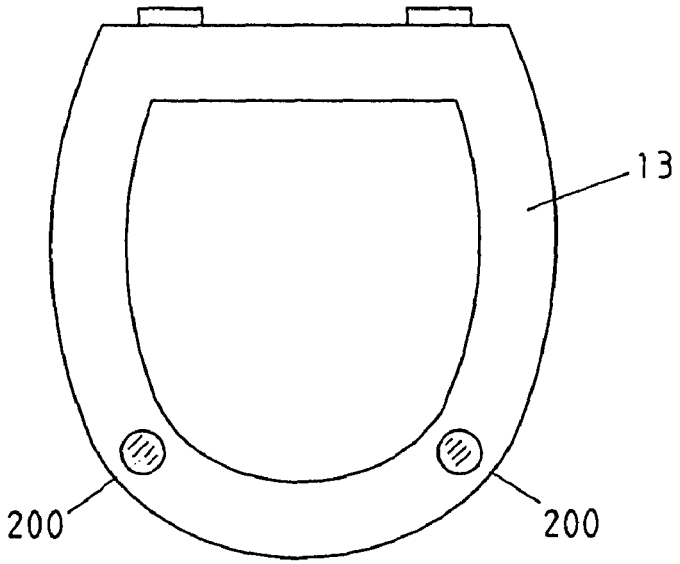
FIG. 4 shows a top view onto the seat board of the toilet with the insert member placed in the seat board for receiving design or decoration objects or a reward game.

As FIG. 3 shows, an indicating sticker is fixed at least in the front area 118 of the toilet cover 16 on the upper cover wall 115, this sticker containing the hint that the toilet cover is to be closed after each use of the toilet and that Lotto numbers are then to be read on the cover upper side, or horoscope results. The indicating label 80 made for example of a plastic foil can also be placed on the inner side of the toilet cover 15 and indicates to the user to close the toilet cover when the user lets open the toilet cover after having used the toilet.

In order to be able to be sure to read the numbers or the texts on the moulded bodies 40 or 141 through the window 21, 121, according to a further embodiment a light source 70 is provided in the area of the window 21,121 situated in the area of the receiving shafts 30, 31, 32, 33, 34, 35 or 130, 131 for the moulded bodies 40 or 141, 141 (FIG. 3 and 16). This light source is particularly advantageous since it is thus possible to lighten the visual area, what is particularly advantageous when a toilet 10 with the reward games 20 and/or 120 is mounted in bad lightened toilet rooms. The current supply of the light source 70 takes place for example over a battery or a solar cell placed in the toilet cover 15 or in the insert member 200, whereby the switching on and off of the light source is controlled by the swivelling movement of the toilet cover 15, i.e. by the opening and/or closing of the toilet cover 15. This being, a control of the lighting duration is also provided by means of a switch clock. The switching on and off of the light source 70 can also take place over a sensor or by means of differently configured control devices.

Figure 18:
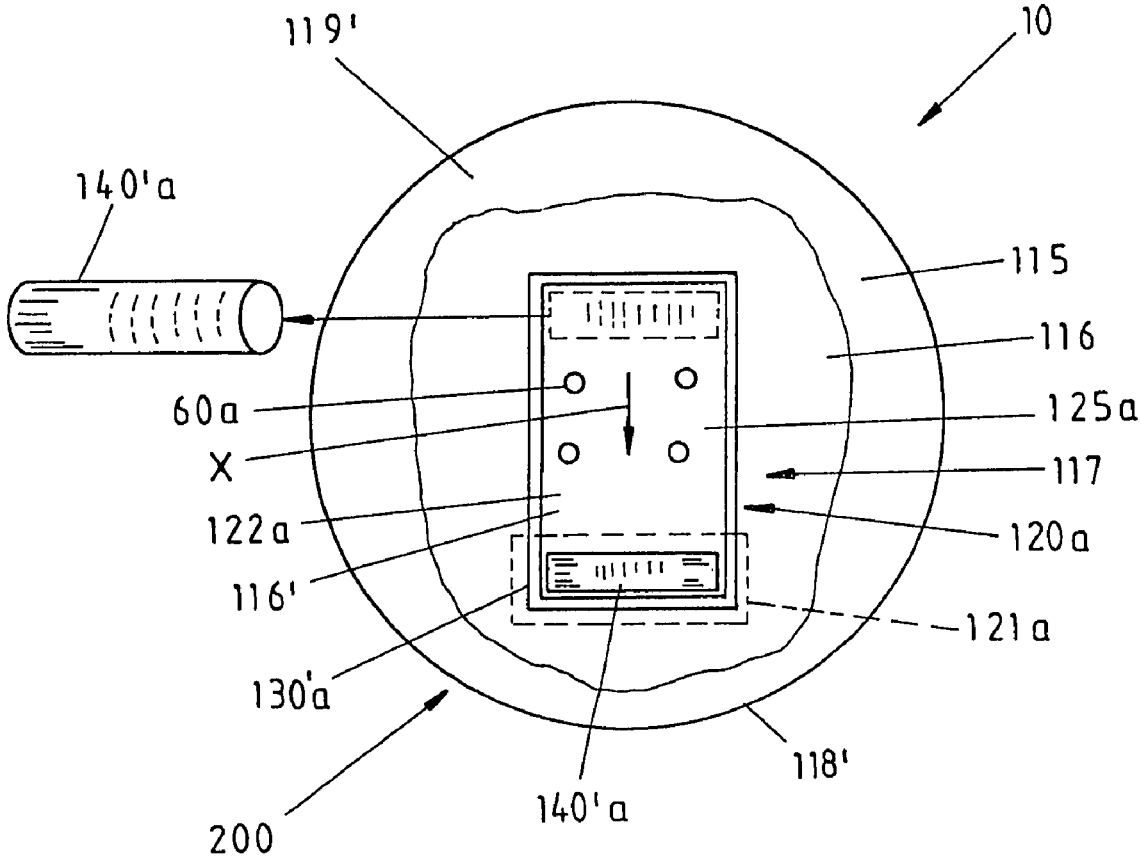
FIG. 18 shows partly as a view, partly as a horizontal section the insert member with an uncovered reward game in a third embodiment.
Figure 19:
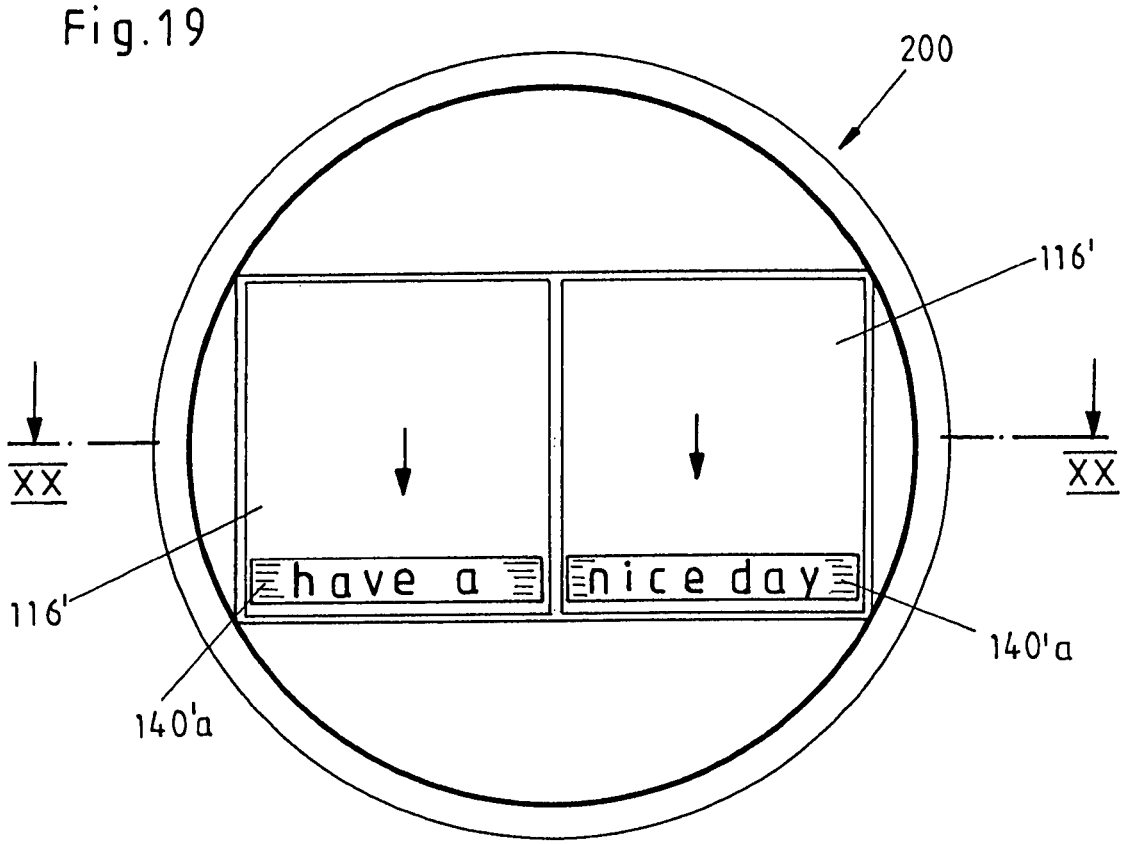
FIG. 19 shows a topview of an insert member with a reward game placed therein.
Figure 20:
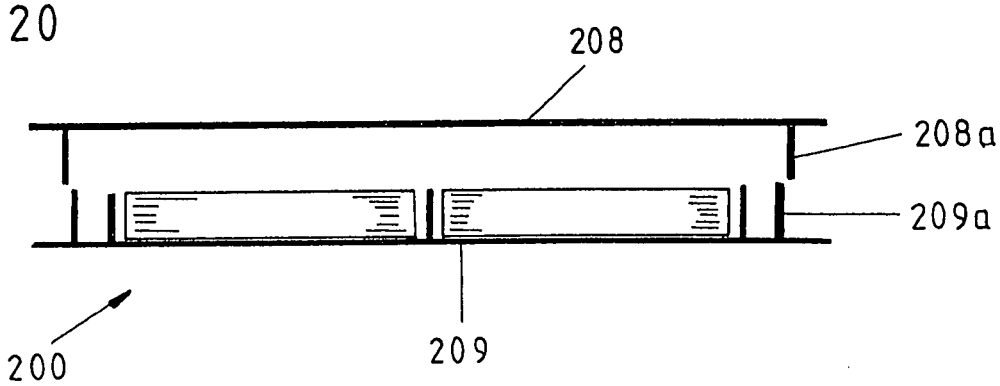
FIG. 20 shows a vertical section according to the line XX-XX of FIG. 19.

A third embodiment of a reward game 120*a* is represented in FIG. 18. For this embodiment also, the insert member 200 is configured with double walls. The inner space 207 of the insert member 200 is delimited by the upper side wall 115 and the lower side wall 116. The reward game 120*a* is constituted by a frame with vertical walls and with a bottom 116' guided ascendingly from the front area 118' to the rear area 119' by constituting a chamber 125*a* in which a cylindrical or roller-shaped moulded body 140'*a* is placed, the surface of which is provided with imprints which make horoscope-type predicts. The width of the moulded body 140'*a* corresponds approximately to the width of the chamber 125*a* which turns in the front area 119' to a receiving shaft 130'*a* in which the moulded body 140'*a* comes to rest, when the toilet cover 15 is closed, whereby the insert member 200 is provided in its upper side wall 115 with a window 121*a* which is provided in the area of the moulded body 140'*a* situated in the receiving shaft 130'*a* so that the characters respectively situated in the window can be read over the window. It is also possible to constitute two chambers or more with receiving shafts. Two paths situated side by side are configured for the moulded bodies 140'*a* (FIG. 19 and 20).

Small cams 60*a* can be placed distributed on the inclined rolling-off surface on the bottom 116'; when the moulded body 140'*a* rolls off in direction of the arrow X, they cause a rotation of the moulded body 140'*a* (FIG. 18).

The moulded bodies can also be replaceable, namely by moulded bodies with other texts, symbols, numbers and the like which can be supplied as additional accessories. The window 21, 121 is provided with a clear cover which can be linked removable or in the art of a hinge in order to be able to be opened and closed for replace the moulded bodies. The hinge-type link of the cover constituting the window preferably takes place on the wall delimiting the receiving shaft 30, 31, 32, 33, 34, 35,130,131.

Figure 21:
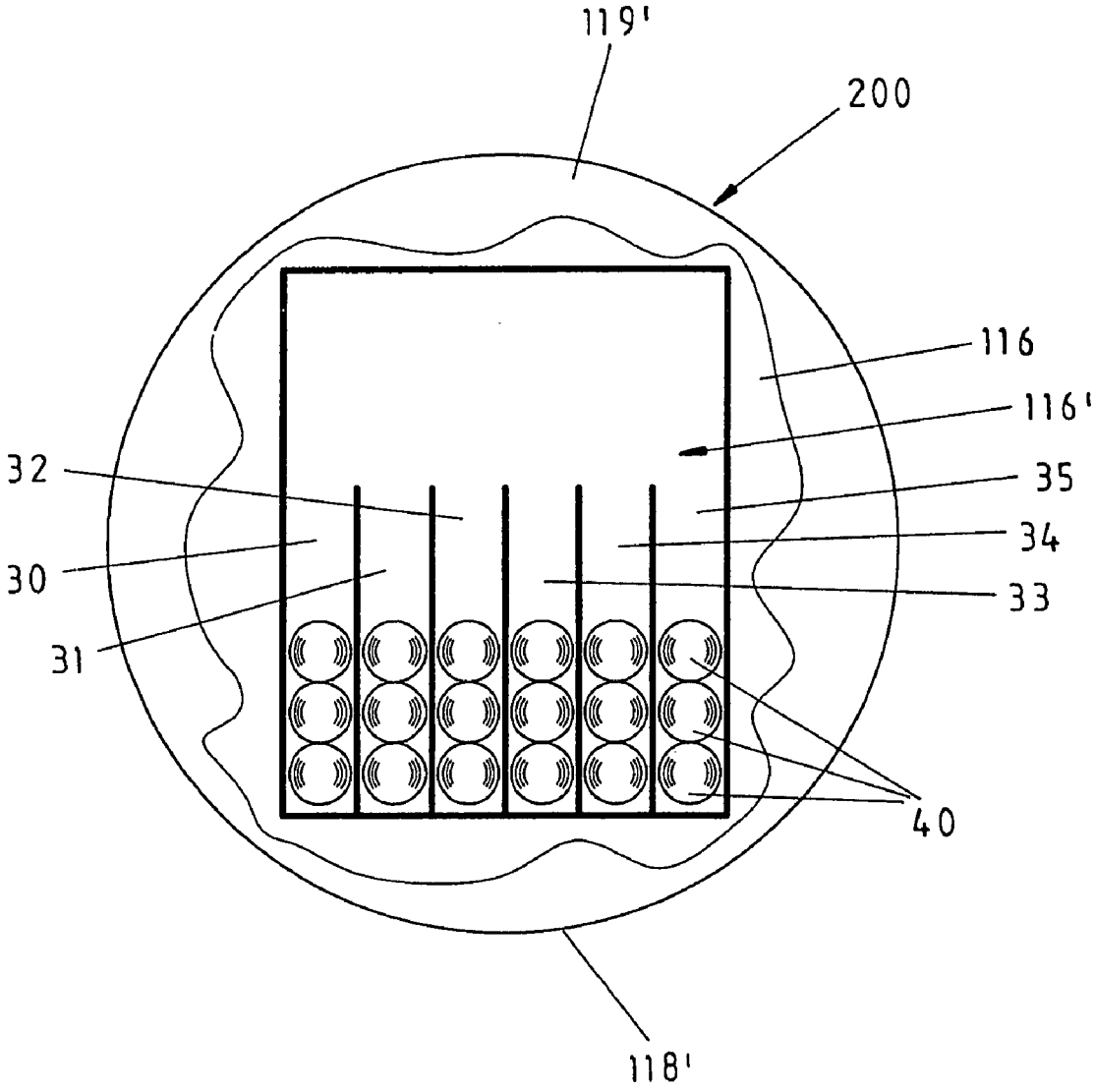
FIG. 21 shows a view of several receiving shafts of the reward game with a row of spherical moulded bodies placed the one behind the other placed in each receiving shaft.
Figure 22:
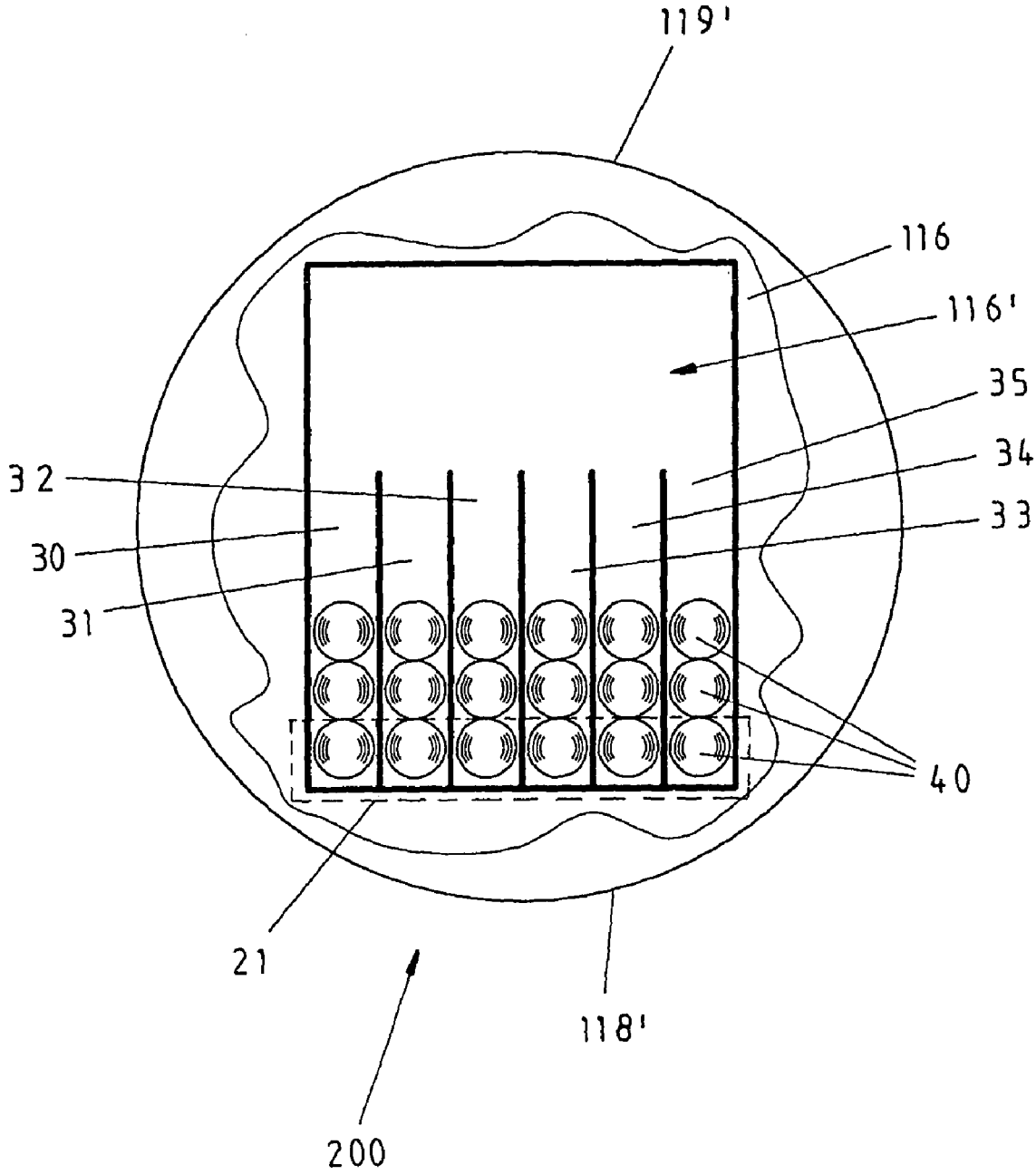
FIG. 22 shows a view of several receiving shafts of the reward game with a row of spherical moulded bodies placed the one behind the other placed in each receiving shaft, whereby the window is placed in the area of the lowerst transverse row of spherical moulded bodies.
Figure 23:
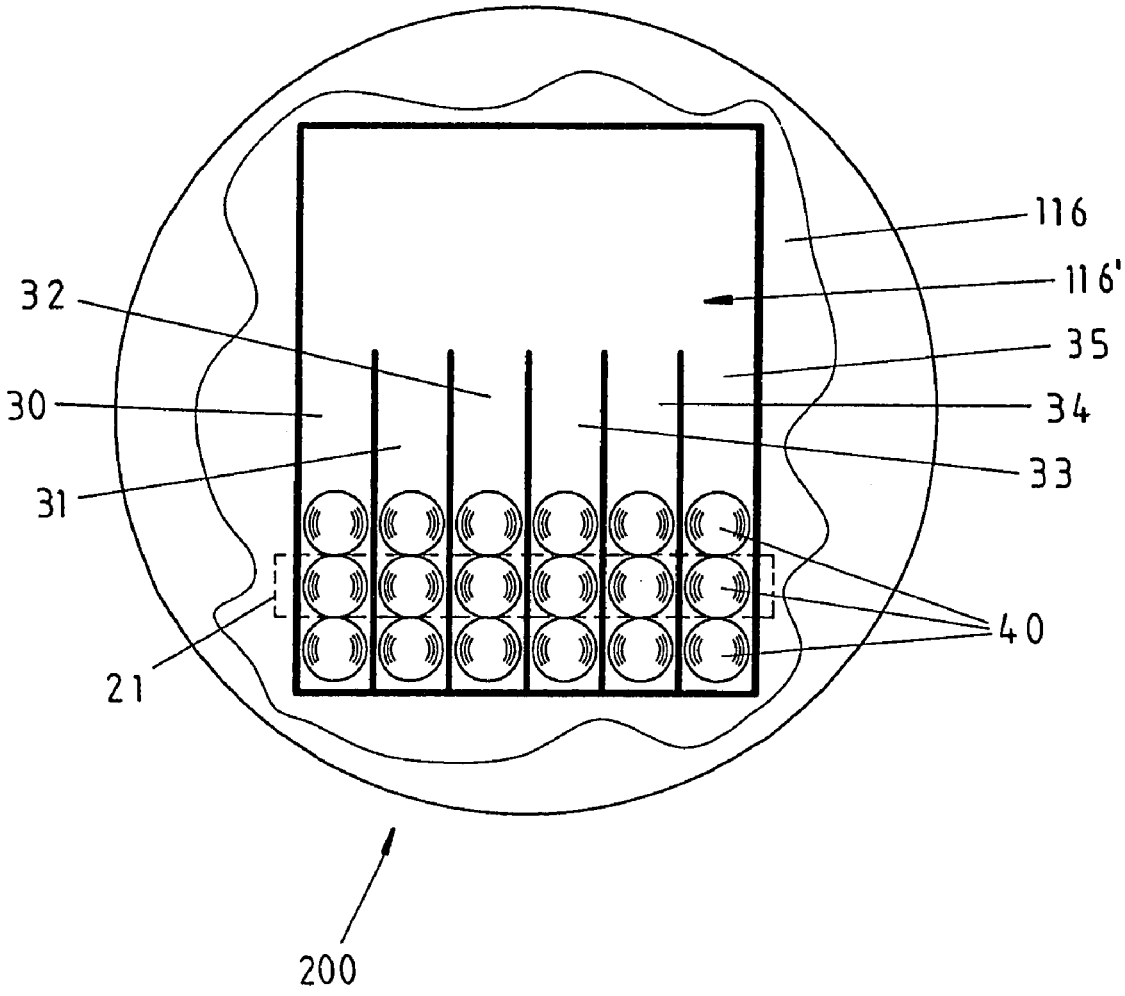
FIG. 23 shows a view of several receiving shafts of the reward game with a row of spherical moulded bodies placed the one behind the other placed in each receiving shaft, whereby the window is placed in the area of a middle transverse row of spherical moulded bodies.
Figure 24:
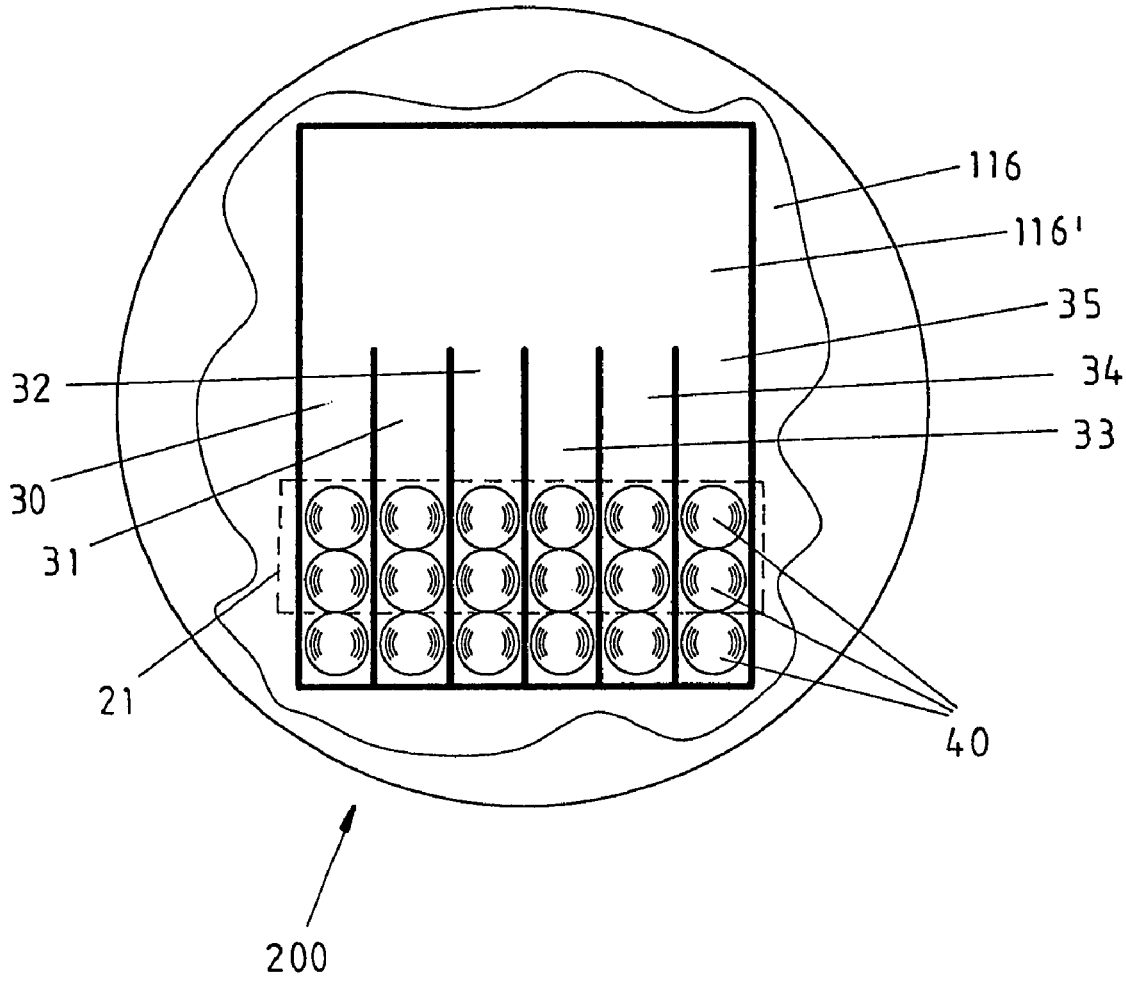
FIG. 24 shows a view of several receiving shafts of the reward game with a row of spherical moulded bodies placed the one behind the other placed in each receiving shaft, whereby the window is placed in the area of two transverse rows of spherical moulded bodies.

The receiving shafts 30, 31, 32, 33, 34, 35 running parallel to each other can have a length according to FIG. 21 which corresponds to a multiple of the diameter of a spherical moulded body 40. So the length of the receiving shafts can be dimensioned in such a manner that for example four spherical moulded bodies 40 come to rest in each receiving shaft, these moulded bodies being then in a row the one behind the other; however, only one spherical moulded body 40 can be situated in the area of the window 21. If, for example, four spherical moulded bodies 40 are situated in each receiving shaft, only the spherical moulded bodies 40 of a transverse row are in the window 41 (FIG. 23). The window can also be dimensioned in such a manner that several transverse rows of spherical moulded bodies 40 are detected (FIG. 24). This window arrangement can also be used for receiving shafts which receive moulded bodies with other geometrical conformations.

Figure 25:
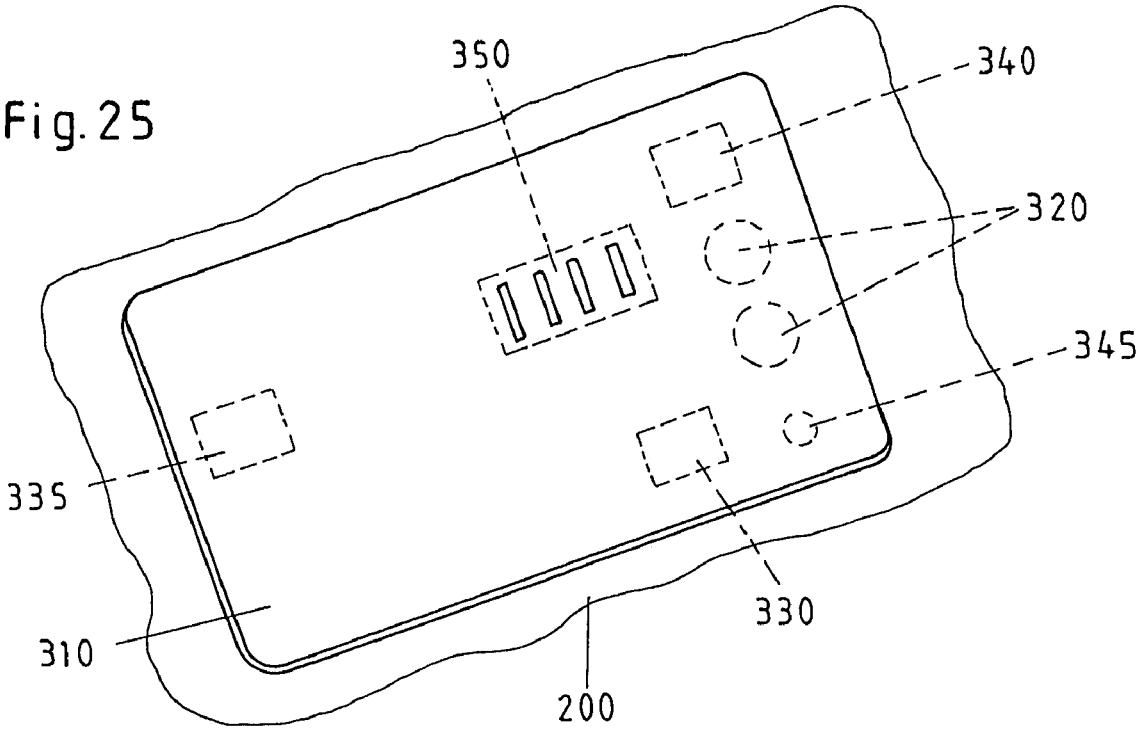
FIG. 25 shows a graphical view of one supporting plate with a speech and/or music module which can be placed in the insert member.
Figure 26:
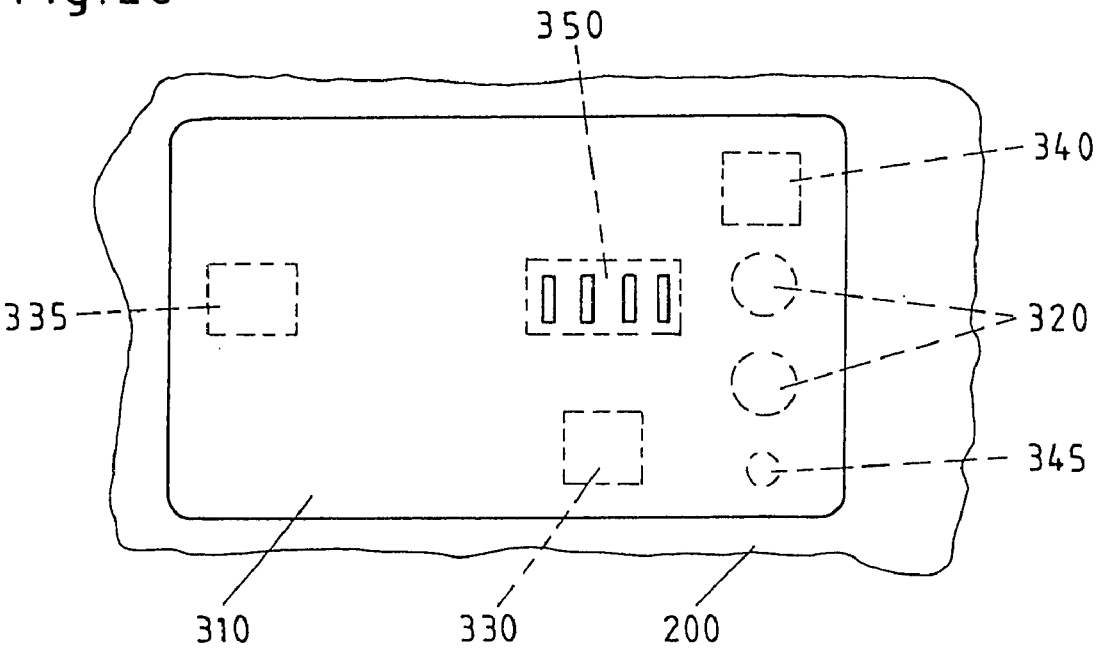
FIG. 26 shows a topview of the supporting plate according to FIG. 26.

The insert member 200 can also be provided with a speech and/or music module 330 which is placed in or on a support plate 310 which is placed on the outer wall face or inner wall face of the insert member 200 or in the inner space 207 of the insert member 200. Accordingly, the insert member 200 is provided with a programmable or preprogrammable speech and/or music module 330 which is connected with a source of current 320, a mechanical, light-optical, heat or pressure controlled circuit closer and breaker 340 and with a sound reproduction device 350, whereby all components are placed in a supporting plate 310 (FIG. 25 and 26).

For the actuation of the speech and/or music module 330, the circuit closer and breaker 340 can also be actuated over the swivelling movement of the toilet cover 15.

The source of current 320 is a battery and/or a solar cell. The sound reproduction device 350 is configured as a loudspeaker. The speech and/or music module 320 is provided with a recording and reproducing device and is connected with a microphone/loudspeaker unit. The circuit closer and breaker 340 is configured as contact switch, motion switch, pressure switch, eye/iris identifying switch, acoustic switch or code reacting switch.

The cover of a wall-hung urinal 15' can also be configured with an insert member 200 in the same way than the toilet cover 15 of a toilet.

The window 21 can also be made of glass or of a clear synthetic material with magnifying properties so that there results the possibility to be able to use also small moulded bodies, the numbers or imprints of which are reproduced enlarged.

Furthermore, the moulded bodies 40, 140, 141, 140'*a* can also be configured as phosphorescent elements or be provided with an outer wall coating made of a substance or medium able to luminescence which have a phosphorescence effect after having been excited by visible light after having switched off the exciting light source or after interruption of a light supply, which thus have a strong phosphorescence. Such phosphorescent colours are made for example of ZuS: Cu. At least one lamp or light-emitting diode with a source of current can also be placed in the insert member 200, whereby the lighting elements are embedded into the material of the insert member 200 or can be placed in the inner space of the insert member configured as a hollow body. So, for example a Christmas tree provided with lamps or differently configured figurative elements, such as for example lightened houses, can be placed together with lamps in the insert member.

The inner space 207 of the insert member 200 which receives the reward game 20, 120 is formed by a lower side wall 116 and an upper side wall 115, whereby both side walls are sticked, welded or connected in another manner with each other in their superimposed edge areas.

If the insert member 200 is made on all sides of a clear synthetic material and if the insert member 200 is mounted in a through bore 210 in the cover 15, 15' or in the seat board 13, the object placed in the inner space 207 of the insert member 200 is visible from both sides, even in liquid form, even if the cover or the seat board is tilted up. If the insert member 200 is made only on one side of a clear synthetic material or is provided with a window only on one side, depending on the arrangement of the insert member 200 in the through bore 210, the object in the inner space 207 of the insert member 200 is visible from the one cover or seat board side or from the other side of the cover or of the seat board. If a multitude of insert members 200 with a filling made of a coloured liquid is placed in the cover 15, 15', a decorative cover design for toilets is created. This is also the case if insert members 200 made of a coloured material are place in the through bores in the cover.

The invention claimed is:

1. A cover (15') for a closable wall-hung urinal (10') comprising a toilet bowl (11) having an inner space for receiving waste and the toilet seat (12) having an opening, the toilet seat is placed on top of the toilet bowl, wherein the cover (15, 15') is placed onto of the toilet seat and toilet bowl therefore completely covers the urinal (10'), wherein the cover (15, 15')

has a bottom face and a top face and a substantially uniform thickness between the bottom face and the top face, wherein the cover is provided with at least one through bore (210) having a top opening at the top face and a bottom opening at the bottom face, wherein the through bore (210) has a constant inner diameter along its entire depth through the entire thickness of the cover from the bottom opening at bottom face to the top opening at the top face, whereby an insert member (200) filling the bore (210) is placed in the bore (210), the bore (210) has the cross-sectional shape of a circle, of an ellipse, of a triangle, of a quad or a polygon or another geometrical shape and the insert member (200) has a conformation corresponding to the shape of the bore (210), wherein the insert member (200) consists of a cap-shaped bottom part (209) and a cap shaped cover part (208) that together form a closed hollow body (205) with an inner space (207), the two cap-shaped parts (208,209) include free peripheral edges and surfaces (115) that have laterally projecting peripheral edge portions (115*a*), wherein the free peripheral edges of the two cap-shape parts formed on lower parts of the surfaces (115) and extended in a direction perpendicular to the surfaces (115) of the two cap-shaped parts (208,209), whereby the cap shaped cover part and cap-shaped bottom part (208, 209) taken together have a height which corresponds to the depth of the through bore (210) in the cover (15, 15') so that when the two cap-shaped parts (208,209) are push into the top and bottom openings of the through bore (210) the free peripheral edges of the two cap-shaped parts (208,209) come to rest on each other whereby simultaneously the laterally projecting edges (115*a*) rest firmly on the top and bottom face of the cover (15), the two cap-shaped parts (208,209) abut each other and are directly connected to each other by groove and projection (208*a*, 209*a*) that are formed on opposed edges of the two cap-shaped parts (208, 209), whereby the two cap-shaped parts (208, 209) are directly overlapped each other and form a clamping or press fit, the insert member (200) being made totally, partially or portion wise of a clear, transparent, milky or translucent material with or without coloration, wherein fixed or movable decoration articles or articles of daily use or functional articles (230) such as lighting means, radio or television, a CD player, a time displaying device, a speech and/or music module with a current production source, liquid means (230*a*) or games (20,120), are arranged in the inner space (207) of the insert member (200) configured as the hollow body (205) so that the insert member along with the articles therein is removable from the bore in the cover and replaceable with another insert member having different articles therein.

2. A cover (15, 15') According to claim 1, wherein the surface of the insert member (200) placed in the bore (210, 210') progressively turns into the surface of the cover (15, 15').

* * * * *